US009021746B1

(12) United States Patent
Uhl

(10) Patent No.: US 9,021,746 B1
(45) Date of Patent: May 5, 2015

(54) BLEACHER SYSTEM

(71) Applicant: Century Industries, LLC, Sellersburg, IN (US)

(72) Inventor: Robert D. Uhl, Louisville, KY (US)

(73) Assignee: Century Industries, LLC, Sellersburg, IN (US)

( * ) Notice: Subject to any disclaimer, the term of this patent is extended or adjusted under 35 U.S.C. 154(b) by 0 days.

(21) Appl. No.: 14/138,707

(22) Filed: Dec. 23, 2013

Related U.S. Application Data

(60) Provisional application No. 61/745,956, filed on Dec. 26, 2012.

(51) Int. Cl.
*E04H 3/12* (2006.01)
*E04B 1/343* (2006.01)

(52) U.S. Cl.
CPC ..... *E04H 3/12* (2013.01); *E04B 1/34357* (2013.01); *E04H 3/126* (2013.01)

(58) Field of Classification Search
CPC ..... E04H 3/126; E04H 3/12; E04B 1/34357
USPC ..... 52/6–10; 296/184.1
See application file for complete search history.

(56) References Cited

U.S. PATENT DOCUMENTS

| | | | | |
|---|---|---|---|---|
| 2,983,968 | A | 5/1961 | Wurn | |
| 3,001,243 | A | 9/1961 | Conn et al. | |
| 3,103,707 | A | 9/1963 | Lappin et al. | |
| 3,478,473 | A | 11/1969 | Hoven | |
| 3,786,951 | A * | 1/1974 | Ruff et al. | 414/495 |
| 3,869,835 | A | 3/1975 | Mackintosh | |
| 3,885,827 | A | 5/1975 | Sanders | |
| 3,914,909 | A * | 10/1975 | McNeal | 52/9 |
| 4,611,439 | A * | 9/1986 | Graham, Jr. | 52/9 |
| 4,909,000 | A | 3/1990 | Mackintosh | |
| 5,327,698 | A | 7/1994 | Uhl | |
| 5,400,551 | A | 3/1995 | Uhl | |
| 5,660,000 | A | 8/1997 | McIntyre | |

(Continued)

FOREIGN PATENT DOCUMENTS

GB 2204338 A 11/1988

OTHER PUBLICATIONS

Century Industries, LLC, Transport Mobile Bleachers Model TSP 300 Product Sheet.

(Continued)

*Primary Examiner* — Adriana Figueroa
(74) *Attorney, Agent, or Firm* — Stites & Harbison, PLLC; David W. Nagle, Jr.

(57) ABSTRACT

A bleacher system has a support structure that includes multiple cross members at spaced intervals, but includes no longitudinal rails. The support structure further includes an axle carrier sub-frame mounted between two of the cross members. One or more tiers are mounted on the support structure. Each tier includes multiple girders at spaced intervals, each girder supporting a plurality of seat supports and a plurality of foot board supports, with seat planks or seats then secured to the seat supports and foot planks secured to the foot board supports in each tier. The bleacher system may be provided with front and/or rear jacks for use when the bleacher system is in a deployed position. The bleacher system may also include a hitch tube to facilitate attachment to a vehicle when the bleacher system is in a transport position.

24 Claims, 24 Drawing Sheets

(56) References Cited

U.S. PATENT DOCUMENTS

| | | | | |
|---|---|---|---|---|
| 5,979,125 | A | 11/1999 | Guillet | |
| 6,003,270 | A | 12/1999 | McIntyre | |
| 7,234,720 | B2 * | 6/2007 | Borglum | 280/414.5 |
| 7,322,640 | B2 * | 1/2008 | Ni et al. | 296/204 |
| 8,296,999 | B2 * | 10/2012 | Uhl | 52/9 |
| 2004/0123529 | A1 * | 7/2004 | Wiese et al. | 52/6 |

OTHER PUBLICATIONS

Century Industries, LLC, Transport Mobile Bleachers Model TSP 180 Product Sheet.

Century Industries, LLC, Transport Mobile Bleachers Model TSP 260 Product Sheet.

* cited by examiner

BLEACHER SYSTEM

CROSS-REFERENCE TO RELATED APPLICATIONS

The present application claims priority to U.S. Provisional Patent Application Ser. No. 61/745,956 filed on Dec. 26, 2012, the entire disclosure of which is incorporated herein by reference.

BACKGROUND OF THE INVENTION

Bleachers (or grandstands) provide seating for an audience for various sporting events, theatrical performances, and other similar events. Permanent bleachers are installed in gymnasiums or other locations where such events are frequent. However, for events that occur on a less frequent basis, temporary bleacher systems may be used. Such temporary bleacher systems are often mounted on some form of mobile framework for ready transport to the location of the event. Once at the appropriate location, the bleacher system can be transitioned from the transport position to a deployed position. Thus, such mobile bleacher systems provide short-term and special event seating without the time and labor required to set up conventional bleachers.

In prior art mobile bleacher systems, hydraulic actuators (or similar mechanical or electromechanical actuators) are often used to transition the bleacher system from the transport position to the deployed position, and vice versa. However, such hydraulic actuators are usually extended during transport and storage, and then retracted to transition the bleacher system to the deployed position. Because the hydraulic actuators are extended, the rods are susceptible to corrosion during transport from exposure to road salt and also susceptible to corrosion from environmental conditions during long periods of storage. Thus, expensive and maintenance-prone rod covers have often been used to address and minimize this problem.

Furthermore, in prior art mobile bleacher systems, complex actuating systems and multiple-step procedures are often required to transition the bleacher system from a transport position to a deployed position, and vice versa.

Furthermore, in prior art mobile bleacher systems, the number of rows in the bleacher system or leg room (pitch) from one seat row to the next is often sacrificed in order to make the bleacher system sufficiently compact for transport.

To address some of these deficiencies of prior art mobile bleacher systems, commonly assigned U.S. Pat. No. 8,296,999, which is incorporated herein by reference, describes a bleacher system (or grandstand) that is comprised of multiple tiers which are mounted on a support structure. The tiers are pivotally mounted to the support structure so that the bleacher system can be readily transitioned from a transport position to a deployed position. In this regard, such transition of the bleacher system from the transport position to the deployed position is achieved through the use of one or more hydraulic actuators (or similar mechanical or electromechanical actuators) that are retracted during transport and storage, and then extended to transition the bleacher system to the deployed position. Thus, the rods are protected from exposure to road salt and environmental conditions during transport and storage. Furthermore, as a result of the configuration of the tiers and their connection to the underlying support structure and each other, deployment requires only a single actuating action. At the same time, there is no sacrifice in the number of rows in the bleacher system or leg room (pitch) from one seat row to the next.

As described in U.S. Pat. No. 8,296,999, in one embodiment, an exemplary bleacher system includes three tiers that are mounted to an underlying support structure, which includes two parallel I-beams (or longitudinal rails) that are spaced from one another and extend the length of the bleacher system, effectively creating a complete trailer frame. Multiple cross members extend between and connect the longitudinal rails along the length of the bleacher system. Wheels and an associated suspension system are mounted to the longitudinal rails to facilitate transport of the bleacher system.

Each tier is then generally constructed of multiple girders at spaced intervals that are operably connected to the underlying support structure. Each girder in each tier supports multiple seat supports and foot board supports, with respective seat planks and foot planks then being secured to the respective seat supports and foot board supports and extending along the length of the bleacher system over such seat supports and foot board supports.

Each girder of the upper tier is connected to a rear strut by a pin connection defining a pivot point. The pivot points defined by the respective pin connections are aligned and effectively define an axis of rotation along the length of the bleacher system. Each rear strut is also connected to the underlying support structure by a pin connection defining another pivot point.

The upper tier is connected to the middle tier by a pin connection defining a pivot point. Again, there are actually multiple such pin connections and associated pivot points that are aligned along the length of the bleacher system that effectively define an axis of rotation along the length of the bleacher system. Furthermore, each girder of the middle tier includes a generally triangular-shaped strut. The pivot point is at a rear corner of this strut, and a lower corner of this strut is mounted to the underlying support structure for rotation about a main pivot point, such that the middle tier can effectively rotate about the main pivot point.

The lower tier is connected to the middle tier by a pin connection defining a pivot point. Again, there are actually multiple such pin connections and associated pivot points that are aligned along the length of the bleacher system that effectively define an axis of rotation along the length of the bleacher system.

With respect to the transition of the bleacher system from the transport position to the deployed position, and vice versa, there is a deployment link support structure that is secured to or integral with the underlying support structure for each hydraulic actuator. Each hydraulic actuator is connected to a respective deployment link support structure at a first end by a pin connection defining a pivot point. The rod of the hydraulic actuator is then connected to the middle tier by a pin connection defining a pivot point.

Furthermore, for each hydraulic actuator, a deployment link is connected to the deployment link support structure by a pin connection defining a pivot point. Each such deployment link extends toward the lower tier with its distal end being connected to a second, shorter deployment link by a pin connection defining a pivot point. The opposite end of this second, shorter deployment link is then connected to the girder of the lower tier by a pin connection defining a pivot point.

In operation, when transitioning from the deployed position to the transport position, each hydraulic actuator is activated in unison, and the respective rods of the hydraulic actuators begin to retract. As the rods retract, the middle tier begins rotating backward about the main pivot point. As a result, the respective pivot points at the pin connections between the middle tier and the lower tier are moved upward, and thus, the lower tier begins rotating toward the middle tier. At the opposite end of the middle tier, the respective pivot points at the pin connections between the middle tier and the upper tier are moved downward. The upper tier thus begins rotating forward. Such simultaneous rotation of the three tiers continues as the rods of the hydraulic actuators retract. Furthermore, once tension is released in the connection between the deployment link and the second, shorter deployment link, these two components begin to rotate and "fold" relative to one another. Rotation of the three tiers ceases when the rods of the hydraulic actuators are fully retracted, at which time the rear struts are each in an upright orientation substantially perpendicular to the underlying support structure, and the bleacher system is in the transport position.

To transition the bleacher system from the transport position back to the deployed position, the respective rods of the hydraulic actuators are extended. The rods effectively push against the middle tier, causing the middle tier to rotate forward about the main pivot point. As a result, the respective pivot points at the pin connections between the middle tier and the lower tier are moved downward, and at the same time, the lower tier begins rotating away from the middle tier. As the lower tier rotates away from the middle tier, the deployment link and the second, shorter deployment link rotate into an aligned position, pushing the lower tier into the deployed position. At the opposite end of the middle tier, the respective pivot points at the pin connections between the middle tier and the upper tier are moved upward. The upper tier thus begins rotating backward. Rotation of the three tiers continues until the rods of the hydraulic actuators are fully extended, and the bleacher system is in the deployed position.

As described in U.S. Pat. No. 8,296,999, in another embodiment, an exemplary bleacher system includes two tiers that are mounted to an underlying support structure, which again includes two parallel I-beams (or longitudinal rails) that are spaced from one another and extend the length of the bleacher system, effectively creating a complete trailer frame. Multiple cross members extend between and connect the longitudinal rails along the length of the bleacher system. Wheels and an associated suspension system are mounted to the longitudinal rails to facilitate transport of the bleacher system.

Each tier is again constructed of multiple girders at spaced intervals that are operably connected to the underlying support structure. Each girder in each tier supports multiple seat supports and foot board supports, with respective seat planks and foot planks then being secured to the respective seat supports and foot board supports and extending along the length of the bleacher system over such seat supports and foot board supports.

Each girder of the upper tier is connected to a rear strut by a pin connection defining a pivot point. The pivot points defined by the respective pin connections are aligned and effectively define an axis of rotation along the length of the bleacher system. Each rear strut is also connected to the underlying support structure by a pin connection defining another pivot point.

The upper tier is connected to the lower tier by a pin connection defining a pivot point. Again, there are actually multiple such pin connections and associated pivot points that are aligned along the length of the bleacher system that effectively define an axis of rotation along the length of the bleacher system. Specifically, each girder of lower tier includes a vertical extension. The pin connection defining the pivot point between the upper tier and the lower tier at each girder is at a first end of this vertical extension, while the opposite end of the vertical extension is connected by a pin connection defining a pivot point to the underlying support structure.

With respect to the transition of the bleacher system from the transport position to the deployed position, and vice versa, a hydraulic actuator is connected to a plate (which is secured to and extends from the support structure) at a first end by a pin connection defining a pivot point. The rod of the hydraulic actuator is then connected to the lower tier by a pin connection defining a pivot point.

In operation, when transitioning from the deployed position to the transport position, when each hydraulic actuator is activated, the respective rods of the hydraulic actuators begin to retract. As the rods begin to retract, the lower tier begins rotating backward. As a result, the respective pivot points at the pin connections between the upper tier and the lower tier are moved downward, and thus, the upper tier begins rotating toward the lower tier. At the same time, the rear struts also begin rotating backward. Such simultaneous rotation of the upper tier and the lower tier continues as the rods of the hydraulic actuators retract. Rotation of the upper tier and the lower tier ceases when the rods of the hydraulic actuators are fully retracted, and the bleacher system is in the transport position.

However, it remains desirable to further simplify the operation of a mobile bleacher system and to incorporate refinements that facilitate the transport and deployment of a mobile bleacher system. Furthermore, some such refinements have applicability to other forms of bleacher systems, including those bleacher systems in which one or more tiers are fixed to the underlying support structure.

SUMMARY OF THE INVENTION

The present invention is bleacher system.

An exemplary bleacher system made in accordance with the present invention includes two tiers—an upper tier and a lower tier. These two tiers are mounted to an underlying support structure, but unlike the bleacher systems described in U.S. Pat. No. 8,296,999, the support structure in the bleacher system of the present invention does not include a separate, complete trailer frame. Rather, in the bleacher system of the present invention, the support structure includes multiple cross members at spaced intervals from one another, but no longitudinal rails that interconnect and provide support to the cross members. The support structure further includes an axle carrier sub-frame which is positioned between two of the cross members of the support structure (as further described below).

The upper tier is constructed from multiple girders at spaced intervals. Each girder supports multiple seat supports and foot board supports, with respective seat planks (or seats) and foot planks then being secured to the respective seat supports and foot board supports and extending along the length of the bleacher system over such seat supports and foot board supports.

Similarly, the lower tier is constructed from multiple girders at spaced intervals. Each girder supports multiple seat supports and foot board supports, with respective seat planks (or seats) and foot planks then being secured to the respective seat supports and foot board supports and extending along the length of the bleacher system over such seat supports and foot board supports.

A rear strut is associated with each girder of the upper tier. In some embodiments, the rear strut terminates in a slide plate (or bearing) that engages and supports the girder. In other embodiments, each rear strut is connected to a girder of the upper tier by a pin connection defining a pivot point, and then is connected to a respective cross member of the underlying support structure by a pin connection defining another pivot point. In either case, there are multiple rear struts, one associated with each girder of the upper tier along the length of the bleacher system. When the bleacher system is in the deployed position, each rear strut thus extends from the girder of the upper tier to a respective cross member of the support structure.

The upper tier is connected to the lower tier by a pin connection defining a pivot point. There are multiple such pin connections and associated pivot points that are aligned along the length of the bleacher system that effectively define an axis of rotation along the length of the bleacher system. Each girder of the lower tier is then connected by a pin connection defining a pivot point to a respective cross member of the support structure.

With respect to the transition of the bleacher system from the transport position to the deployed position, and vice versa, a hydraulic actuator (or similar mechanical or electromechanical actuator) extends between a respective cross member of the support structure and the lower tier. In operation, when transitioning from the deployed position to the transport position, the hydraulic actuator is activated, and the rod of the hydraulic actuator begins to retract. As the rod begins to retract, the lower tier begins rotating about an axis of rotation. As a result, the respective pivot points at the pin connections between the upper tier and the lower tier are moved downward, and thus, the upper tier begins rotating toward the lower tier. In other words, the extension of the rod of the hydraulic actuator causes the lower tier to pivot relative to the support structure in a first direction, while causing the upper tier to pivot relative to the support structure in an opposite direction. Such simultaneous rotation of the upper tier and the lower tier continues as the rod of the hydraulic actuator retracts. Rotation of the upper tier and the lower tier ceases when the rod of the hydraulic actuator is fully retracted, and the bleacher system is in the transport position.

During the transition of the bleacher system from the deployed position to the transport position, a front jack (or support leg) and a rear jack (or support leg) associated with each cross member are also moved into a transport position. Specifically, the front jack is pivotally connected to the cross member at the main pivot, i.e., at the pin connection between each girder of the lower tier and the cross member. The rear jack is pivotally connected to the cross member near the rear strut. A jack link then extends between and connects the front jack to a jack link driver, which, in turn, is connected to the rear jack. Thus, in operation, when the lower tier begins rotating, the front jack also begins to rotate, and as result of the use of the jack link and the jack link driver, the rear jack rotates with the front jack.

During the transition of the bleacher system from the deployed position to the transport position, the front jack and the rear jack rotate to a substantially horizontal orientation for transport.

During the transition of the bleacher system from the transport position to the deployed position, the front jack and the rear jack rotate to a substantially vertical orientation for engaging the underlying ground surface and providing support to the bleacher system.

Returning now to the support structure of the bleacher system, as stated above, the support structure includes multiple cross members at spaced intervals from one another, along with and an axle carrier sub-frame which is positioned between two of the cross members. The axle carrier sub-frame is comprised primarily of two beams that extend between and are connected to two of the cross members of the support structure and are oriented substantially perpendicular to the cross members.

The ends of the two beams are substantially identical to one another. Specifically, each end of each beam terminates in a bracket. The bracket defines a hole for receiving a tube, which then also passes through a corresponding hole defined by an adjacent cross member, thus connecting the beam to the cross member. In some embodiments, the tube also defines the pin connection between the girder of the lower tier and the cross member of the support structure. In some embodiments, the tube also passes through the front jack, thus creating the pivot connection between the front jack and the cross member.

Finally, the support structure also includes appropriate brackets mounted to the two beams to accommodate an axle to mount and drive the wheels of the bleacher system.

As a further refinement, a bleacher system made in accordance with the present invention may include a retractable hitch tube for supporting a hitch that enables the bleacher system to be towed behind a truck. Specifically, when the bleacher system is in a transport position, the hitch tube, which has a hitch at its distal end, extends from the front of the bleacher system (i.e., an extended position) so that the hitch can be readily connected to a truck, and the bleacher system can be towed behind the truck. However, when the bleacher system is in a deployed position, the hitch tube can be retracted into the bleacher system (i.e., a retracted position). Use of such a hitch tube eliminates further weight and costs associated with a separate hitch support structure.

DETAILED DESCRIPTION OF THE INVENTION

Figure 1:
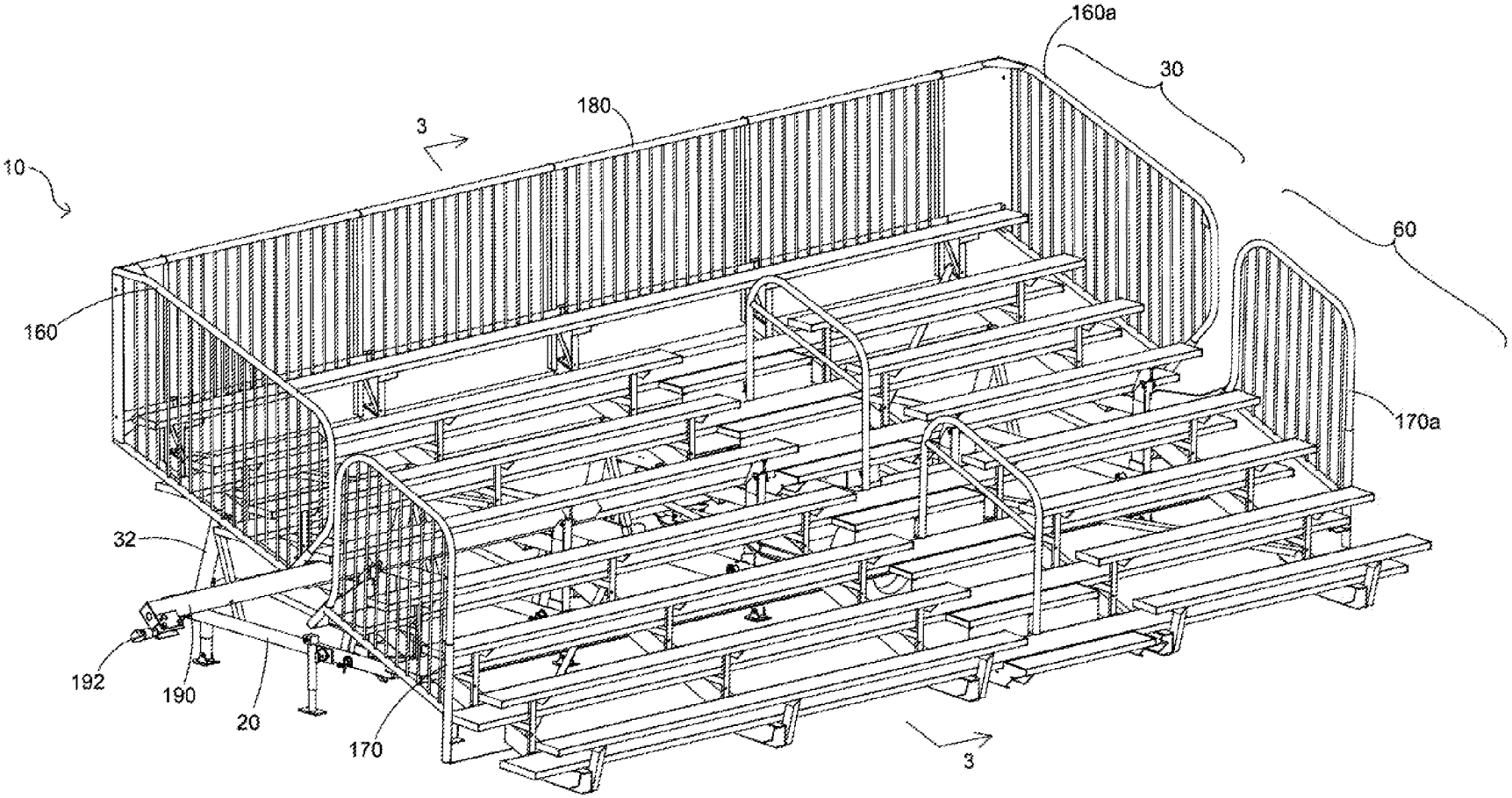
FIG. 1 is a perspective view of an exemplary bleacher system made in accordance with the present invention in a deployed position.

Referring first to FIGS. 1-7, similar to one of the embodiments described in U.S. Pat. No. 8,296,999, an exemplary bleacher system 10 made in accordance with the present invention includes two tiers—an upper tier 30 and a lower tier 60. These two tiers 30, 60 are mounted to an underlying support structure 20, but unlike the bleacher systems described in U.S. Pat. No. 8,296,999, the support structure 20 in the bleacher system of the present invention does not include a separate, complete trailer frame (as will be further described below). Rather, in the bleacher system of the present invention, certain structural components support the load while in a transport position, eliminating the weight of a separate trailer frame. Of course, reducing weight provides a number of benefits, including lighter truck requirements, less transport fuel, lighter trailer vehicle certification requirements (e.g., brakes, tires, axles, hitch), lighter driver certification requirements, and less turf damage.

Referring still to FIGS. 1-7, the upper tier 30 is constructed from multiple girders 40 at spaced intervals. In the exemplary embodiment, five such girders 40 are spaced at approximately six-foot intervals. Each girder 40 supports multiple seat supports 42 and foot board supports 44, with respective seat planks (or seats) 43 and foot planks 45 then being secured to the respective seat supports 42 and foot board supports 44 and extending along the length of the bleacher system 10 over such seat supports 42 and foot board supports 44.

Similarly, the lower tier 60 is constructed from multiple girders 70 at spaced intervals. Each girder 70 supports multiple seat supports 72 and foot board supports 74, with respective seat planks (or seats) 73 and foot planks 75 then being secured to the respective seat supports 72 and foot board supports 74 and extending along the length of the bleacher system 10 over such seat supports 42 and foot board supports 74.

Figure 2:
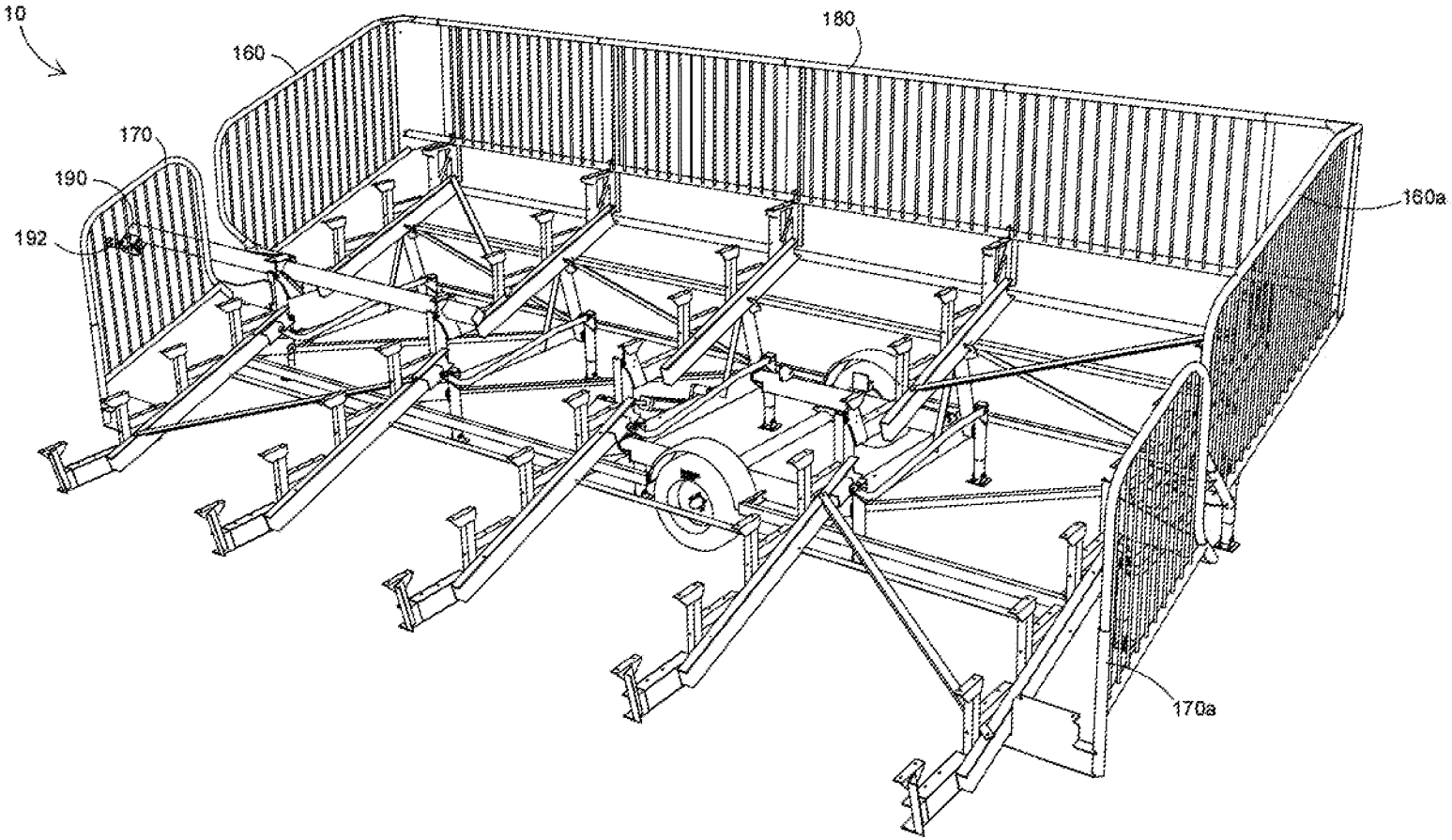
FIG. 2 is another perspective view of the exemplary bleacher system of FIG. 1, but with some components removed to better illustrate certain aspects of the construction of the bleacher system.
Figure 2A:
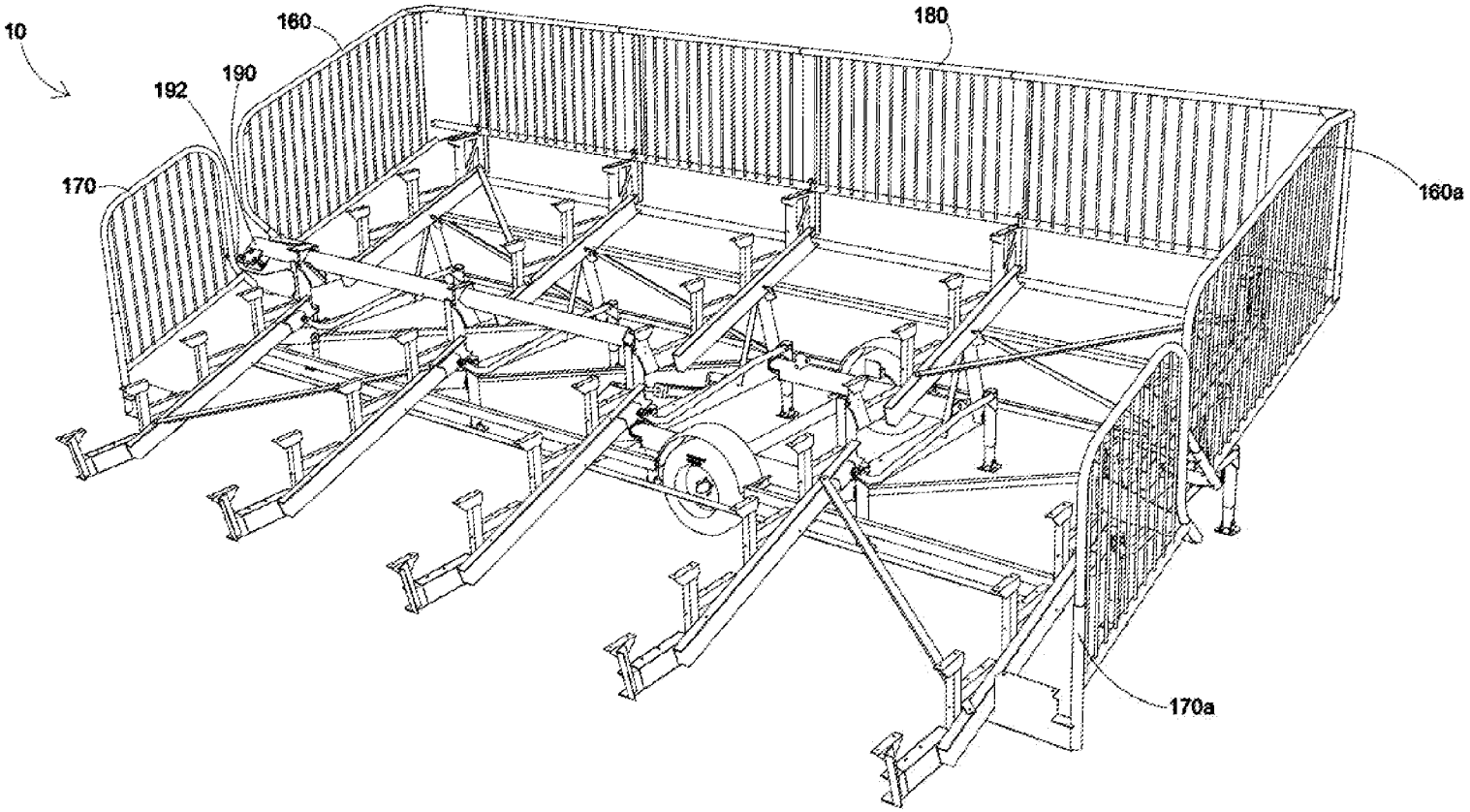
FIG. 2A is a perspective view substantially identical to FIG. 2, but with the hitch tube in a retracted position.

A rear strut 32 is associated with each girder 40 of the upper tier 30. The rear strut 32 terminates in a slide plate (or bearing) 33 that engages and supports the girder 40, but, in this exemplary embodiment, is not attached to the girder 40. As shown in FIGS. 2 and 2A, in which some components have been removed to better illustrate certain aspects of the construction, there are actually multiple rear struts 32, one associated with each girder 40 along the length of the bleacher system 10. When the bleacher system 10 is in the deployed position, each rear strut 32 thus extends from a girder 40 of the upper tier to a respective cross member 25 of the support structure 20 (as further described below with respect to FIGS. 8-11 and 8A-11A), where it is connected to the support structure 20.

The upper tier 30 is connected to the lower tier 60 by a pin connection defining a pivot point 62 (i.e., "tiers pivot"). There are actually multiple such pin connections and associated pivot points 62 that are aligned along the length of the bleacher system 10 that effectively define an axis of rotation along the length of the bleacher system 10. Specifically, each girder 70 of the lower tier 60 includes a vertical extension 71. The pin connection defining the pivot point 62 between the upper tier 30 and the lower tier 60 at each girder 70 is at an upper end of this vertical extension 71. Each girder 70 of the lower tier 60 is then connected by a pin connection defining a pivot point 64 to a respective cross member 25 of the support structure 20.

Now, with respect to the transition of the bleacher system 10 from the transport position to the deployed position, and vice versa, a hydraulic actuator 140 (or similar mechanical or electromechanical actuator) extends between a respective cross member 25 of the support structure 20 and the lower tier 60. Specifically, in this exemplary embodiment, the hydraulic actuator 140 is connected to the cross member 25 at a first end by a pin connection defining a pivot point 122. The rod 142 of the hydraulic actuator 140 is then connected to the lower tier 60 by another pin connection defining a pivot point 124.

Because of this construction, the bleacher system 10 can be readily transitioned from the transport position to the deployed position by extending the hydraulic actuator 140.

Referring now to FIGS. 3-6, in operation, when transitioning from the deployed position to the transport position, the hydraulic actuator 140 is activated, and the rod 142 of the hydraulic actuator 140 begins to retract. As the rod 142 begins to retract, the lower tier 60 begins rotating backward (counterclockwise in FIGS. 3-6) about the axis of rotation defined by the aligned pivots points 64 (or "main pivot"). As a result, the respective pivot points 62 at the pin connections between the upper tier 30 and the lower tier 60 are moved downward, and thus, the upper tier 30 begins rotating toward the lower tier 60 (clockwise in FIGS. 3-6). In other words, the extension of the rod 142 of the hydraulic actuator 140 causes the lower tier 60 to pivot about the main pivot 64 relative to the support structure 20 in a first direction, while causing the upper tier 30 to pivot relative to the support structure 20 in an opposite direction.

Figure 6:
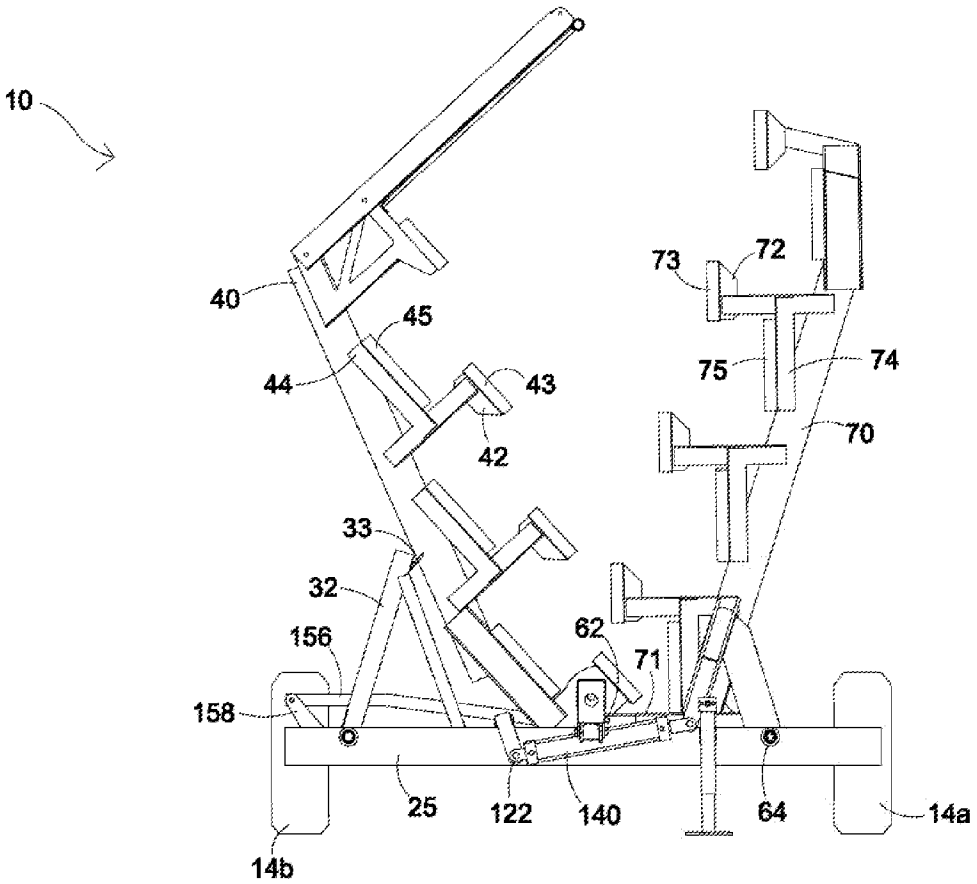
FIG. 6 is a side sectional view similar to FIG. 4, illustrating the bleacher system in the transport position.
Figure 7:
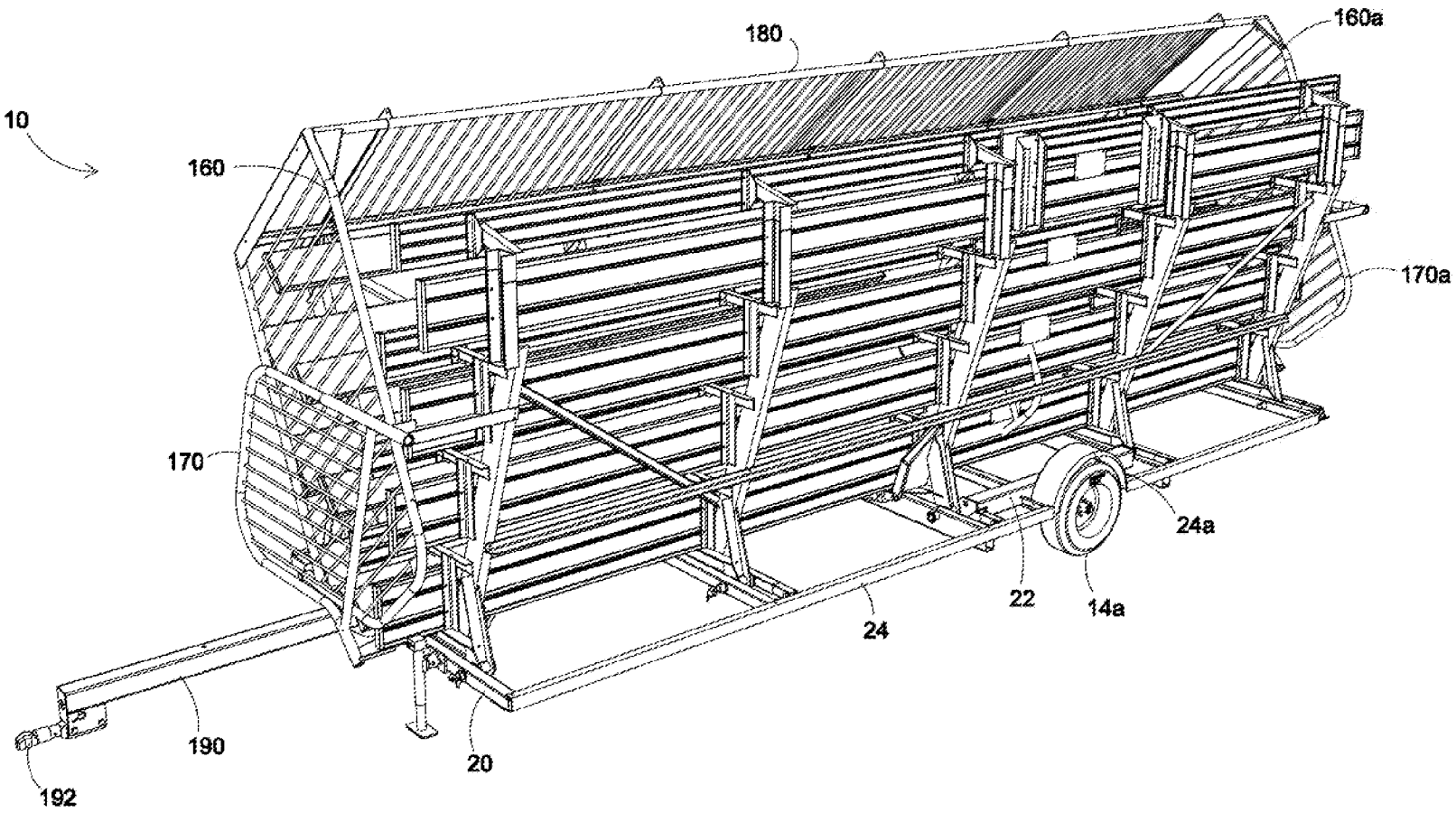
FIG. 7 is a perspective view of the exemplary bleacher system of FIG. 1 in the transport position.
Figure 8:
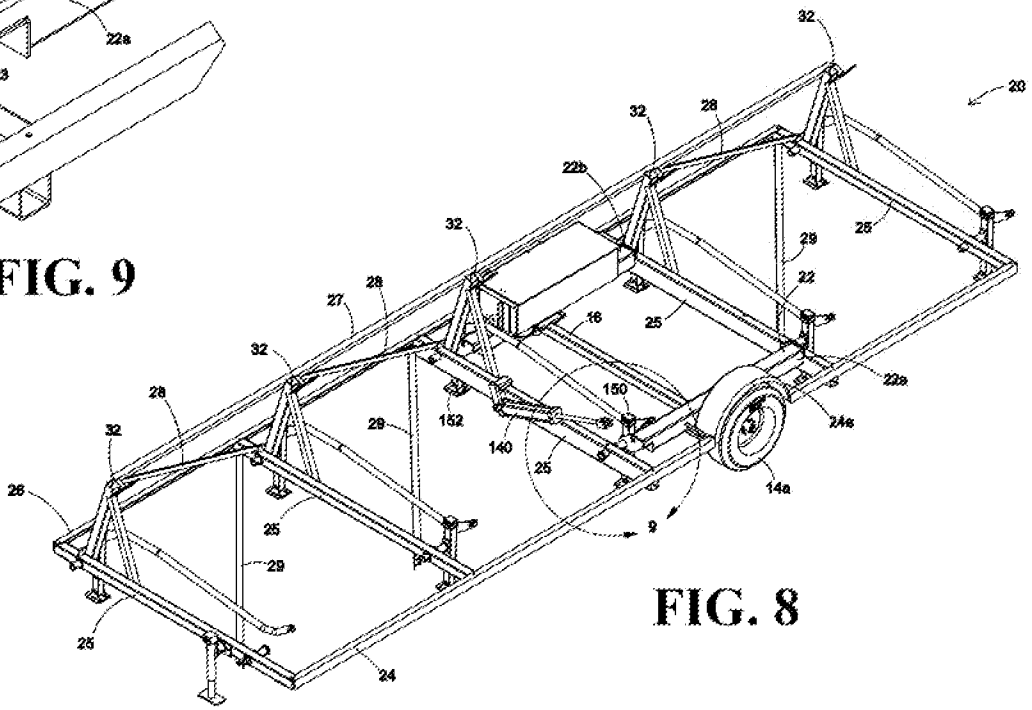
FIG. 8 is a top perspective view of the support structure of the exemplary bleacher system of FIG. 1, with certain components removed for clarity.
Figure 8A:
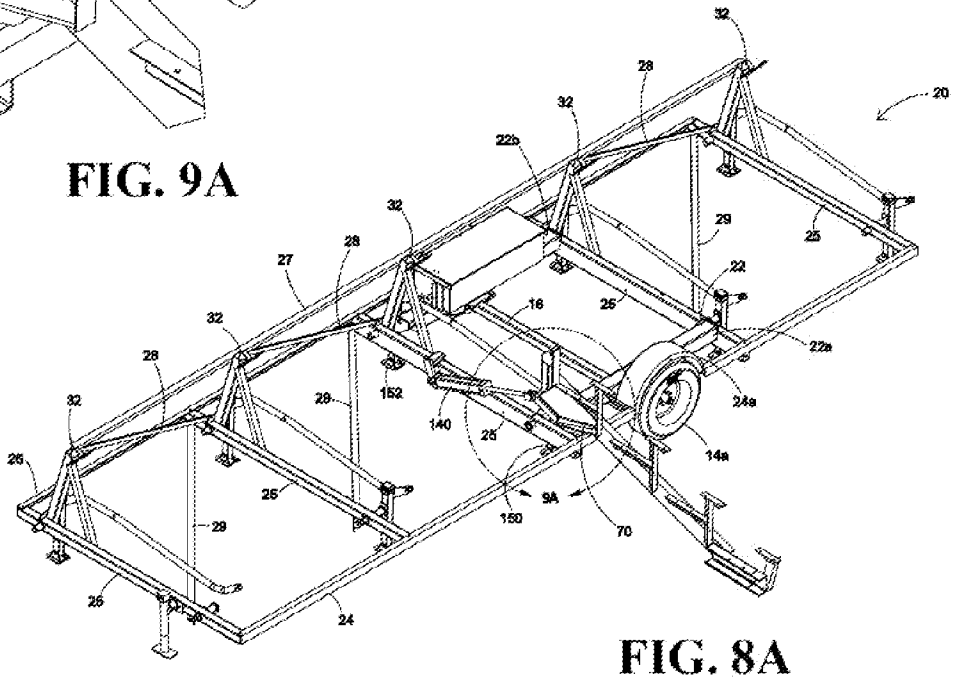
FIG. 8A is a view substantially identical to FIG. 8, but further illustrating a portion of the lower tier.

Such simultaneous rotation of the upper tier 30 and the lower tier 60 continues as the rod 142 of the hydraulic actuator 140 retracts. As shown in FIG. 6, rotation of the upper tier 30 and the lower tier 60 ceases when the rod 142 of the hydraulic actuator 140 is fully retracted, and the bleacher system 10 is in the transport position.

Referring still to FIGS. 3-6, during the transition of the bleacher system 10 from the deployed position to the transport position, a front jack (or support leg) 150 and a rear jack (or support leg) 152 associated with each cross member 25 are also moved into a transport position. Specifically, the front jack 150 is pivotally connected to the cross member 25 at the main pivot 64, and the front jack 150 is also connected to the girder 70 of the lower tier 60. The rear jack 152 is pivotally connected to the cross member 25 near the rear strut 32. A jack link 156 then extends between and connects the front jack 150 to a jack link driver 158, which, in turn, is connected to the rear jack 152. Thus, in operation, when the lower tier 60 begins rotating about the main pivot 64, the front jack 150 also begins to rotate, and as a result of the use of the jack link 156 and the jack link driver 158, the rear jack 152 rotates with the front jack 150. In other words, the front jack 150 and the rear jack 152 rotate together.

During the transition of the bleacher system 10 from the deployed position to the transport position, the front jack 150 and the rear jack 152 rotate (counterclockwise in FIGS. 3-6) to a substantially horizontal orientation for transport; see FIG. 6, where the front jack 150 and the rear jack 152 are hidden from view behind the cross member 25.

Figure 3:
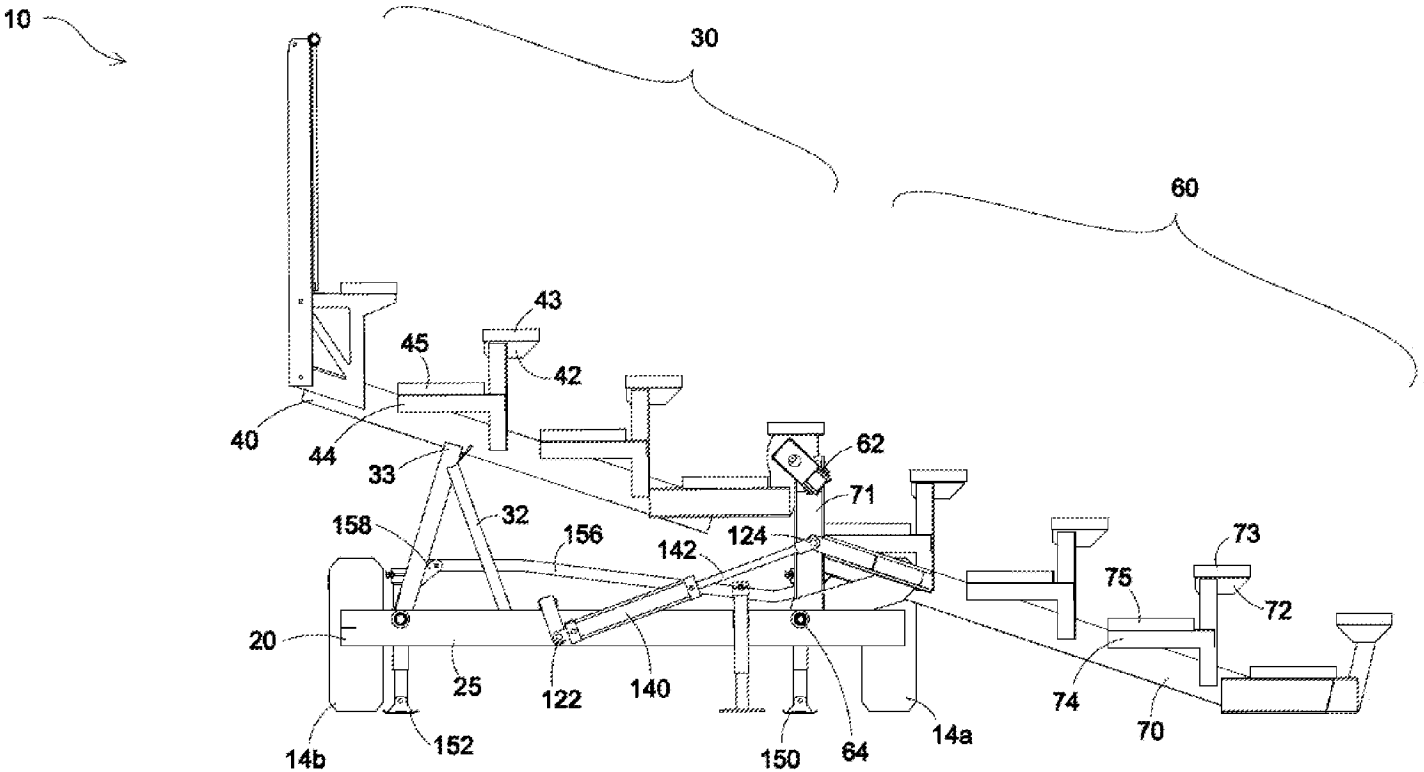
FIG. 3 is a side sectional view of the exemplary bleacher system taken along line 3-3 of FIG. 1 in the deployed position, but with certain components, including the end guardrails, removed for clarity.
Figure 4:
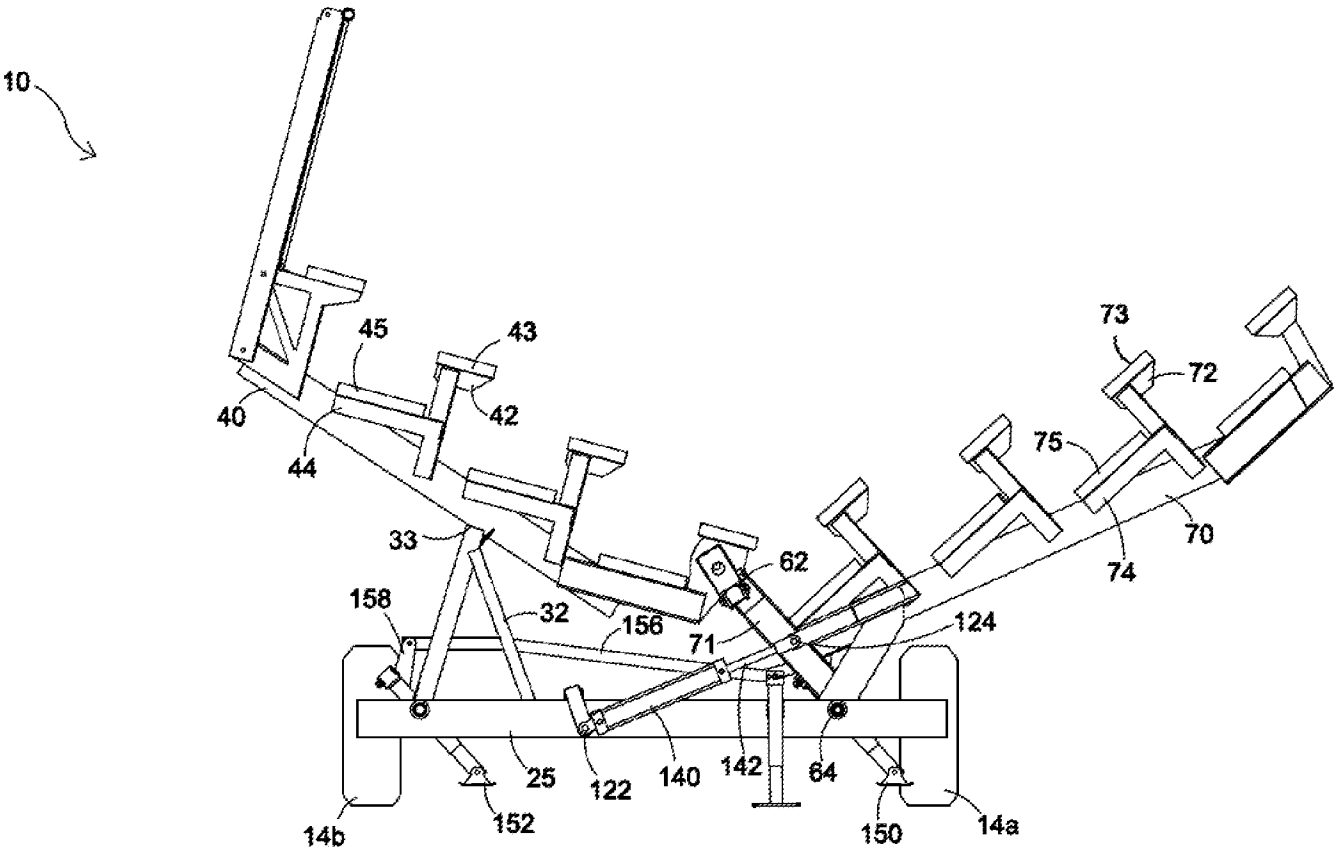
FIG. 4 is a side sectional view similar to FIG. 3, illustrating the bleacher system as it starts to transition from the deployed position to a transport position.
Figure 5:
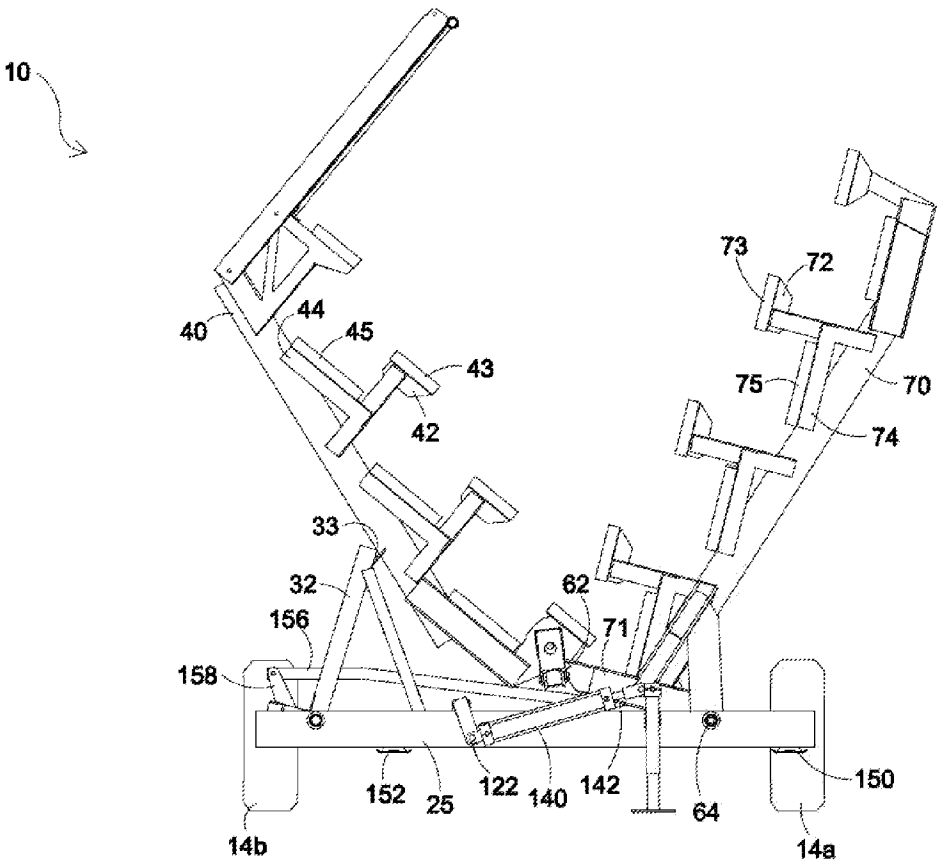
FIG. 5 is a side sectional view similar to FIG. 3, illustrating the bleacher system as it continues to transition from the deployed position to the transport position.

During the transition of the bleacher system 10 from the transport position to the deployed position, the front jack 150 and the rear jack 152 rotate (clockwise in FIGS. 3-6) to a substantially vertical orientation for engaging the underlying ground surface and providing support to the bleacher system 10; see FIG. 3.

The use of such front and rear jacks 150, 152 along the length of the bleacher system 10 allows, in part, for the reduction of size of the cross members 25 of the support structure 20, as the front and rear jacks 150, 152 reduce loads and bending stresses on the cross members 25. Such a reduction of size (and weight) can thus allow for more seat rows, increased seat spacing, or additional leg room from one seat row to the next, but without increasing the overall height of the bleacher system 10 in the transport position.

FIGS. 8-11 and 8A-11A are various views of the support structure 20 of the bleacher system 10, with certain components removed for clarity. In FIGS. 8-11, the lower tier 60 has been hidden entirely from view, but in FIGS. 8A-11A, a portion of one girder 70 of the lower tier 60 is shown to illustrate its interaction with certain components of the support structure 20.

As shown in FIGS. 8-11 and 8A-11A, the support structure 20 of the bleacher system 10 includes multiple cross members 25 at spaced intervals from one another, along with an axle carrier sub-frame 22 which is positioned between two of the cross members 25. In this exemplary embodiment, there are two safety guards 24, 26 that extend along the length of the bleacher system 10, and each such safety guard 24, 26 includes a "break" to accommodate a curved panel 24*a*, 26*a* that defines a wheel well on each side of the support structure 20. These safety guards 24, 26 are not I-beams as in the bleacher systems of U.S. Pat. No. 8,296,999; these safety guards 24, 26 are simply to cover and protect the ends of the cross members 25 and provide no structural support. In other words, the bleacher system 10 would be fully operational without the safety guards 24, 26.

Referring still to FIGS. 8-11 and 8A-11A, the axle carrier sub-frame 22 is positioned between two of the cross members 25 of the support structure 20. The axle carrier sub-frame 22 is comprised primarily of two beams 22*a*, 22*b* that extend between and are connected to two of the cross members 25 of the support structure 20 and are oriented substantially perpendicular to the cross members 25.

Figure 9:
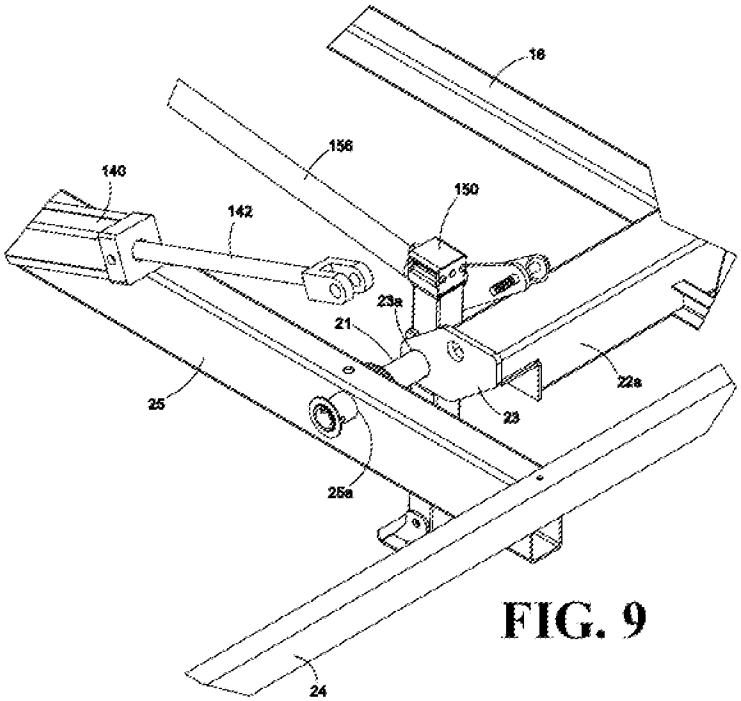
FIG. 9 is an enlarged perspective view of a portion of the support structure of FIG. 8.
Figure 9A:
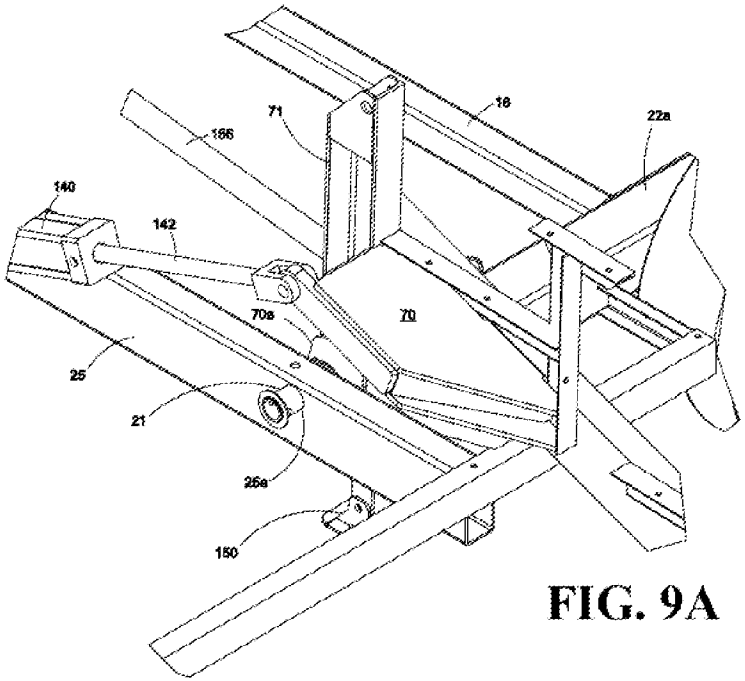
FIG. 9A is a view substantially identical to FIG. 9, but further illustrating a portion of the lower tier.
Figure 10:
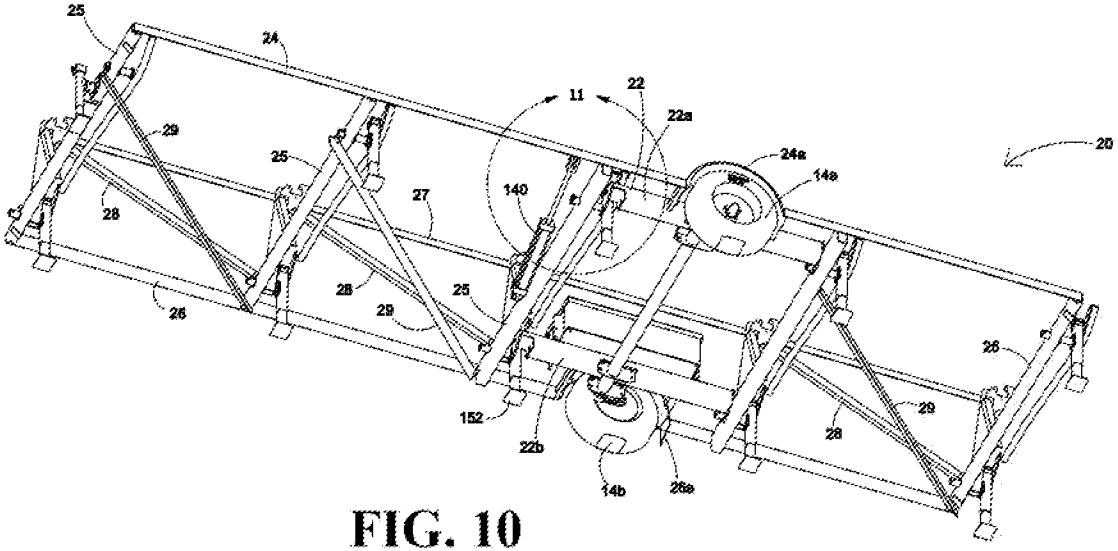
FIG. 10 is a bottom perspective view of the support structure of the exemplary bleacher system of FIG. 1, with certain components removed for clarity.
Figure 11:
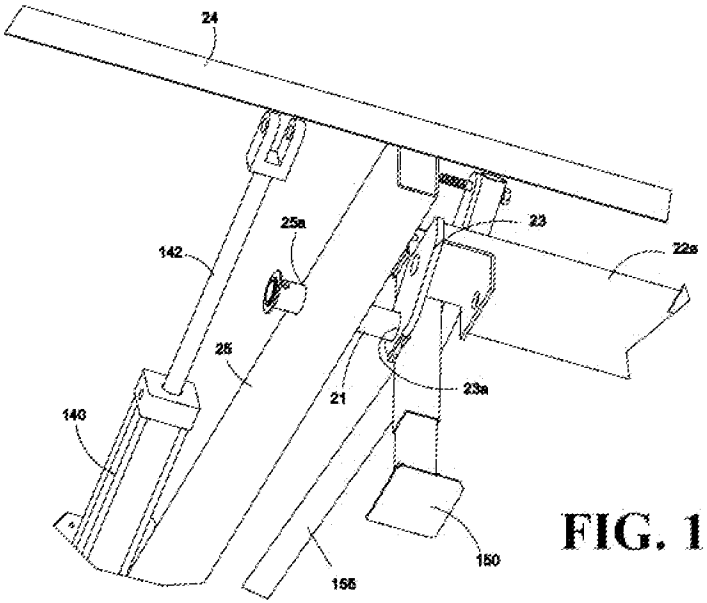
FIG. 11 is an enlarged perspective view of a portion of the support structure of FIG. 10.
Figure 10A:
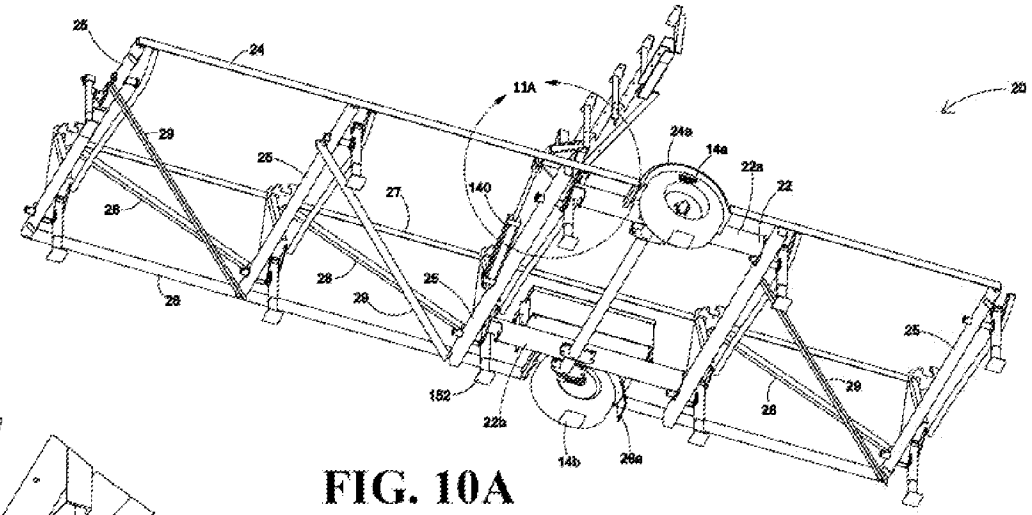
FIG. 10A is a view substantially identical to FIG. 10, but further illustrating a portion of the lower tier.
Figure 11A:
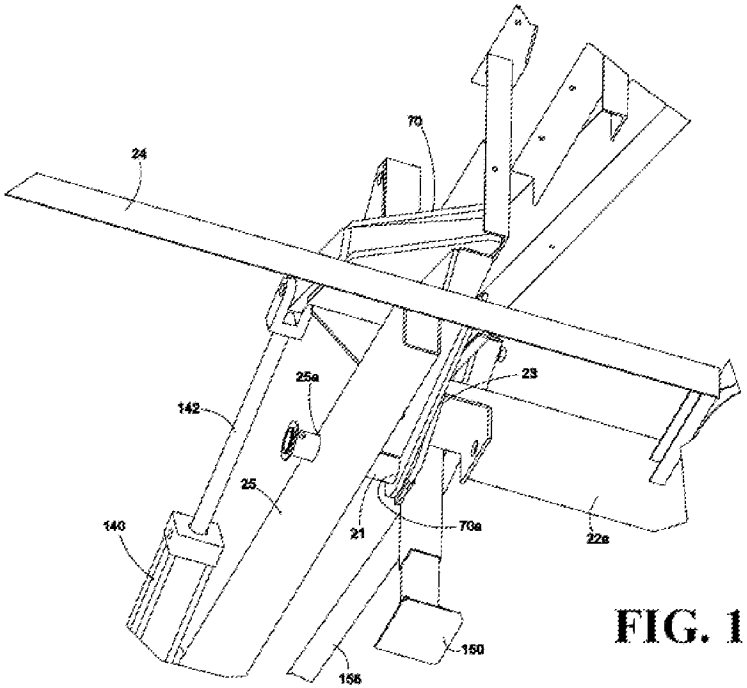
FIG. 11A is a view substantially identical to FIG. 11, but further illustrating a portion of the lower tier.

FIGS. 9, 9A, 11, and 11A are enlarged views of the end of one beam 22*a*, but the ends of the two beams 22*a*, 22*b* are substantially identical. Specifically, the respective ends of the first beam 22*a* each terminate in a bracket 23. The bracket 23 defines a hole 23*a* for receiving a tube 21, which then also passes through a corresponding hole 25*a* defined by the cross member 25, thus connecting the first beam 22*a* to the cross member 25. In this exemplary embodiment, the tube 21 shown in FIGS. 9, 9A, 11, and 11A also defines the main pivot 64, i.e., the pin connection between the girder 70 of the lower tier 60 and the cross member 25 of the support structure 20. As mentioned above, in FIGS. 9A and 11A, a portion of one girder 70 of the lower tier 60 is shown to illustrate its interaction with certain components of the support structure 20. FIGS. 9A and 11A thus show how the tube 21 passes through a lower portion 70*a* of the girder 70 between the bracket 23 and the cross member 25, thus creating the pin connection between the girder 70 of the lower tier 60 and the cross member 25 of the support structure 20

In this exemplary embodiment, the tube 21 shown in FIGS. 9, 9A, 11, and 11A also passes through the front jack 150, thus creating the pivot connection between the front jack 150 and the cross member 25. Of course, since the ends of the first beam 22*a* are substantially identical to one another, there is a similar connection to another cross member at the other end and a pivotal connection to another front jack 150.

Referring now to FIGS. 8, 8A, 10, and 10A, since the second beam 22*b* is substantially identical to the first beam 22*a*, there are similar connections of the second beam 22*b* to the cross members 25 near the rear struts 32, which also create the pivot connection between the rear jacks 152 and the cross members 25.

Referring again to FIGS. 8-11 and 8A-11A, the support structure 20 also includes appropriate brackets mounted to the two beams 22*a*, 22*b* to accommodate an axle 16 to mount and drive the wheels 14*a*, 14*b* of the bleacher system 10.

Referring again to FIGS. 8, 8A, 10, and 10A, in the exemplary bleacher system 10, the support structure 20 also includes a rear support bar 27 that extends the length of the bleacher system 10 and connects the rear struts 32 to one another. As a further refinement, the support structure 20 can include cross braces 28 that each extend from the top end of one of the rear struts 32 near the slide plate 33 to an adjacent cross member 25. As a further refinement, the support structure 20 can also include cross braces 29 that extend diagonally from one cross member 25 to another.

As a result of such construction and the positioning of the axle carrier sub-frame 22, there is a direct load path between the axle carrier sub-frame 22 and respective tiers 30, 60 of the bleacher system. Thus, in a transport position, the tiers 30, 60 of girders, seat supports, and foot board supports are effectively supported by the axle carrier sub-frame 22 and the cross members 25. It is not necessary for the support structure 20 to include parallel I-beams or any similar longitudinal rails along the length of the bleacher system 10. In other words, it is not necessary to build a complete trailer frame under the tiers 30, 60, as the tiers 30, 60 of girders, seat supports, and foot board supports effectively form a trailer frame in the transport position.

Furthermore, and as shown in FIGS. 1, 2, and 2A, in this exemplary embodiment, the bleacher system 10 include guardrails: left and right end guardrails 160, 160*a* associated with and secured to the upper tier 30; left and right end guardrails 170, 170*a* associated with and secured to the lower tier 60; and a rear guardrail 180 that extends the length of the bleacher system 10. As the bleacher system 10 is transitioned from the deployed position to the transport position, the end guardrails 160, 160*a*, 170, 170*a* are also transitioned from a deployed position to a transport position such that they are essentially in a stacked relationship with respect to one another at each end of the bleacher system 10.

As a further refinement, and as shown in FIG. 1, the exemplary bleacher system 10 also includes a central staircase. The individual stairs are secured to the respective seat supports 42, 72 and/or foot board supports 44, 74, and thus also rotate and transition from the deployed position to the transport position in the same manner as the respective seat planks (or seats) 43, 73 and foot planks 45, 75. Furthermore, the exemplary bleacher system 10 also includes handrails associated with the central staircase. Each handrail is associated with and secured to a respective tier 30, 60, but such handrails are only installed when the bleacher system 10 is in the deployed position and must be removed when the bleacher system 10 is transitioned to the transport position.

As a further refinement, and referring now to FIGS. 1, 2, 2A, and 7, the bleacher system may include a retractable hitch tube 190 for supporting a hitch 192 that enables the bleacher system to be towed behind a truck. Specifically, when the bleacher system is in a transport position, the hitch tube 190, which has a hitch 192 at its distal end, extends from the front of the bleacher system 10 (i.e., an extended position) so that the hitch 192 can be readily connected to a truck, and the bleacher system 10 can be towed behind the truck. However, when the bleacher system 10 is in a deployed position, the hitch tube 190 can be retracted into the bleacher system 10 (i.e., a refracted position). Specifically, the hitch tube 190 is adapted for sliding movement, so that it can be effectively pushed into the bleacher system and essentially stowed under a row of seating; see FIG. 2A. In this exemplary embodiment, multiple brackets are positioned at intervals that support the hitch tube 190 along its length, while still allowing the sliding movement of the hitch tube 190 relative to the remainder of the bleacher system 10. Of course, the hitch tube 190 is prevented by a stop or similar means from being entirely slid out of the bleacher system 10 so it can still perform its essential function of facilitating towing of the bleacher system 10. In this exemplary embodiment, the hitch tube 190 rotates with the girders 40 of the upper tier 30 as the bleacher system 10 transitions from a deployed position to a transport position so it is properly oriented for use in the transport position. In any event, use of such a hitch tube 190 eliminates further weight and costs associated with a separate hitch support structure.

FIGS. 12-15 are side sectional views of another exemplary bleacher system 210 made in accordance with the present invention. This bleacher system 210 has a construction very similar to that described above with respect to FIGS. 1-7, including an upper tier 230 constructed from multiple girders 240 at spaced intervals. Each girder 240 supports multiple seat supports 242 and foot board supports 244, with respective seat planks (or seats) 243 and foot planks 245 then being secured to the respective seat supports 242 and foot board supports 244 and extending along the length of the bleacher system 210 over such seat supports 242 and foot board supports 244. Similarly, the lower tier 260 is constructed from multiple girders 270 at spaced intervals. Each girder 270 supports multiple seat supports 272 and foot board supports 274, with respective seat planks (or seats) 273 and foot planks 275 then being secured to the respective seat supports 272 and foot board supports 274 and extending along the length of the bleacher system 210 over such seat supports 272 and foot board supports 274.

Unlike the construction described above with respect to FIGS. 1-7, however, in this exemplary bleacher system 210, each rear strut 232 is connected to a girder 240 of the upper tier 230 by a pin connection defining a pivot point 234, and then is connected to a respective cross member 225 of the underlying support structure 220 by a pin connection defining another pivot point 236 (i.e., "rear pivot"). Of course, there are again multiple rear struts 232 and associated pivots points 234, 236, one associated with each girder 240 along the length of the bleacher system 210.

The upper tier 230 is again connected to the lower tier 260 by a pin connection defining a pivot point 262 (i.e., "tiers pivot"). Again, there are actually multiple such pin connections and associated pivot points 262 that are aligned along the length of the bleacher system 210 that effectively define an axis of rotation along the length of the bleacher system 210. Each girder 270 of the lower tier 260 is then connected by a pin connection defining a pivot point 264 to a respective cross member 225 of the support structure 220.

Referring still to FIGS. 12-15, a hydraulic actuator 340 (or similar mechanical or electromechanical actuator) extends between a respective cross member 225 of the support structure 220 and the lower tier 260. Specifically, in this exemplary embodiment, the hydraulic actuator 340 is connected to the cross member 225 at a first end by a pin connection defining a pivot point 322. The rod 342 of the hydraulic actuator 340 is then connected to the lower tier 260 by another pin connection defining a pivot point 324. In operation, when transitioning from the deployed position to the transport position, the hydraulic actuator 340 is activated, and the rod 342 of the hydraulic actuator 340 begins to retract. As the rod 342 begins to retract, the lower tier 60 begins rotating backward (counterclockwise in FIGS. 12-15) about the axis of rotation defined by the aligned pivots points 264 (or "main pivot"). As a result, the respective pivot points 262 at the pin connections between the upper tier 230 and the lower tier 260 are moved downward, and thus, the upper tier 230 begins rotating toward the lower tier 260 (clockwise in FIGS. 12-15) about the axis of rotation defined by the aligned pivot points 234. At the same time, the rear struts 232 also begin rotating backward (counterclockwise in FIGS. 12-15) about the axis of rotation defined by the aligned pivot points 236. In other words, the extension of the rod 342 of the hydraulic actuator 340 causes the lower tier 260 to pivot about the main pivot 264 relative to the support structure 220 in a first direction, while causing the upper tier 230 to pivot about the pivot points 236 relative to the support structure 220 in an opposite direction.

Referring still to FIGS. 12-15, during the transition of the bleacher system 210 from the deployed position to the transport position, a front jack (or support leg) 350 and a rear jack (or support leg) 352 associated with each cross member 225 are also moved into a transport position. Specifically, the front jack 350 is pivotally connected to the cross member 225 at the main pivot 264, and the front jack 350 is also connected to the girder 270 of the lower tier 260. The rear jack 352 is pivotally connected to the cross member 225 near the rear strut 232. A jack link 356 then extends between and connects the front jack 350 to a jack link driver 358, which, in turn, is connected to the rear jack 352. Thus, in operation, when the lower tier 260 begins rotating about the main pivot 264, the front jack 350 also begins to rotate, and as result of the use of the jack link 356 and the jack link driver 358, the rear jack 352 rotates with the front jack 350. In other words, the front jack 350 and the rear jack 352 rotate together.

Figure 15:
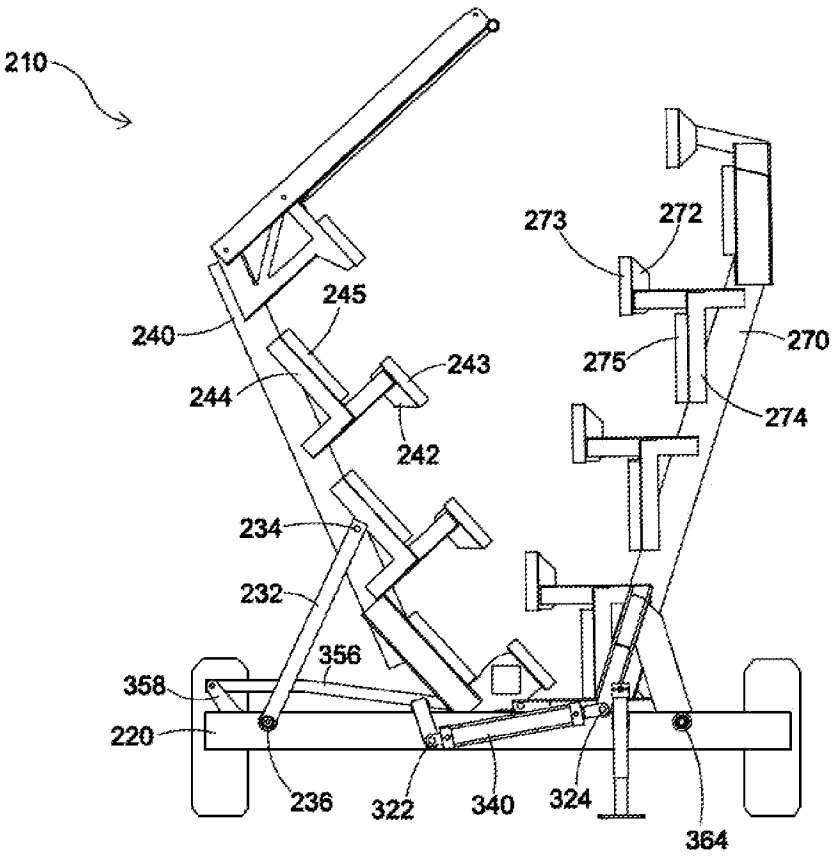
FIG. 15 is a side sectional view similar to FIG. 12, illustrating the bleacher system in the transport position.

During the transition of the bleacher system 210 from the deployed position to the transport position, the front jack 350 and the rear jack 352 rotate (counterclockwise in FIGS. 12-15) to a substantially horizontal orientation for transport; see FIG. 15, where the front jack 350 and the rear jack 352 are hidden from view behind the cross member 225.

Figure 12:
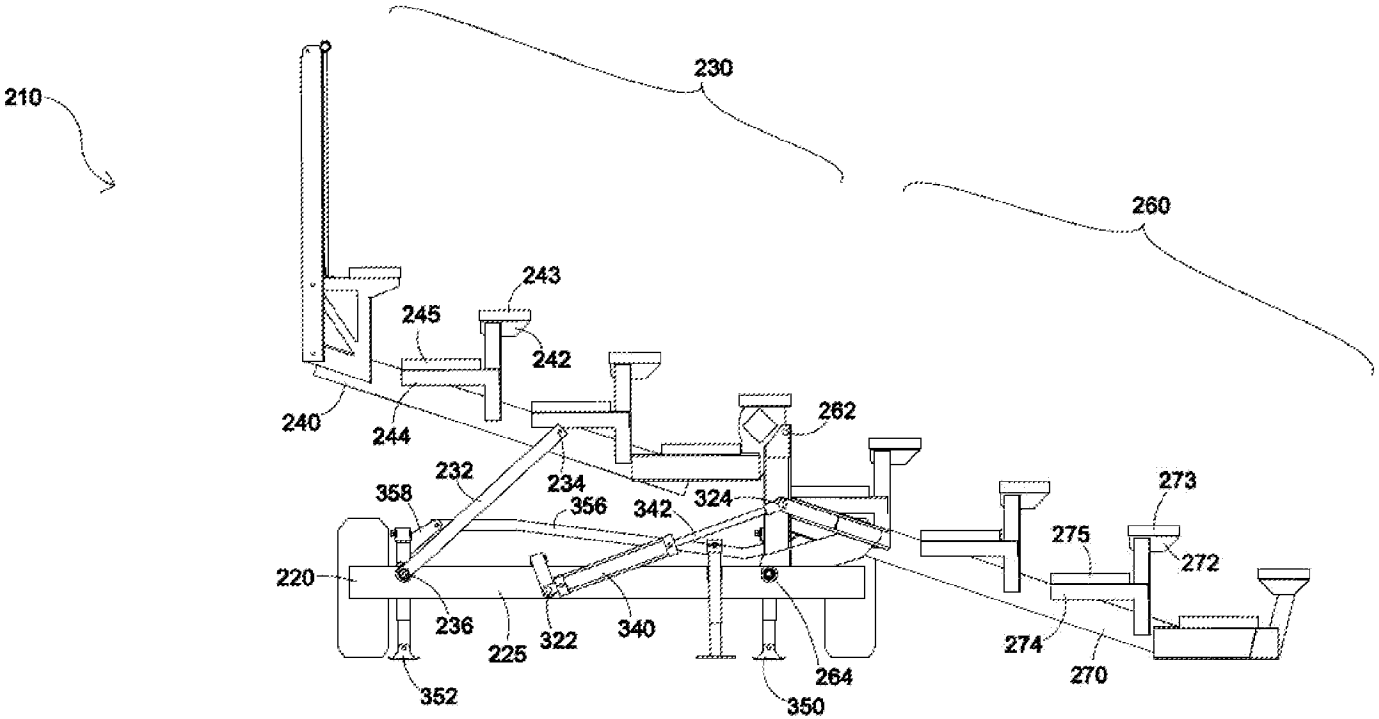
FIG. 12 is a side sectional view of another exemplary bleacher system in a deployed position, but with certain components, including the end guardrails, removed for clarity.
Figure 13:
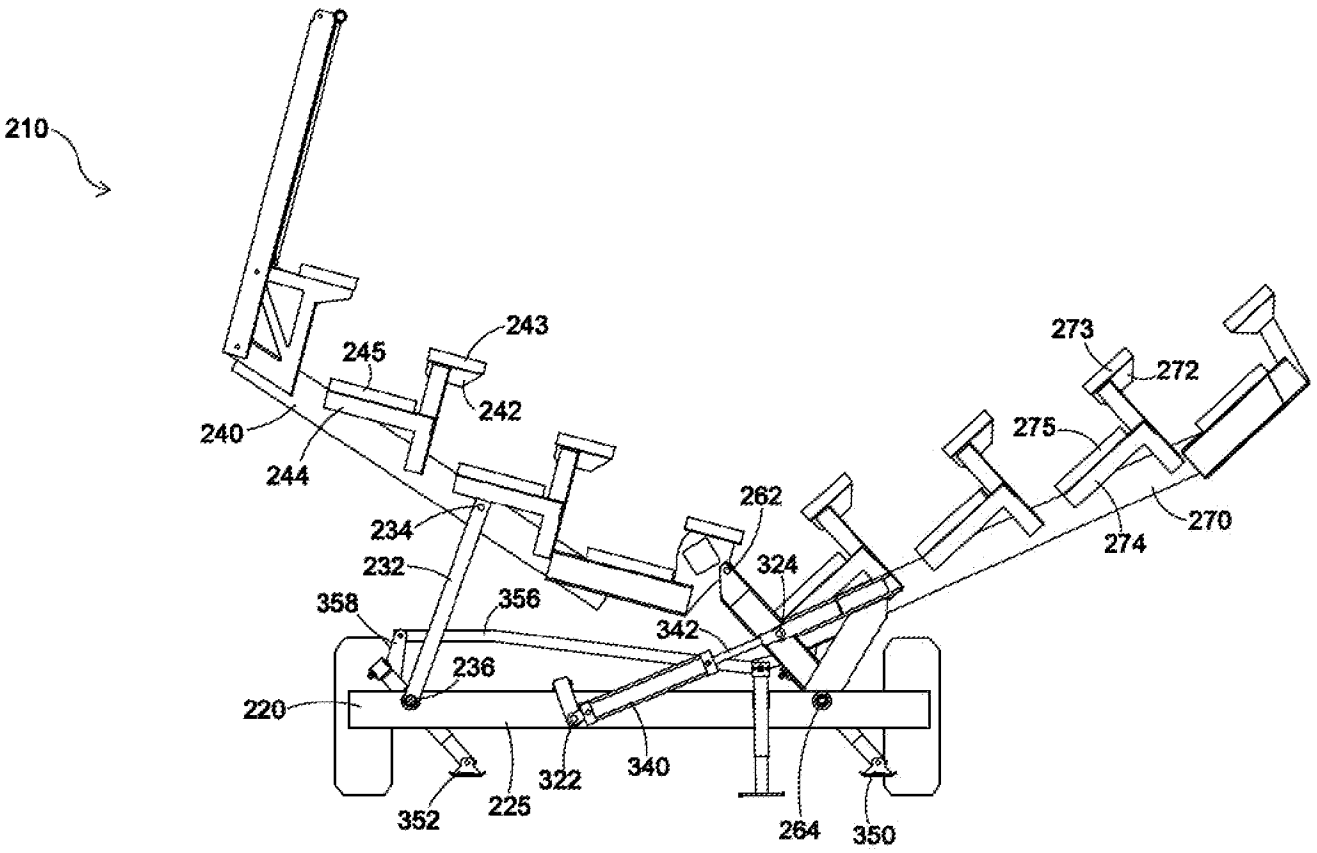
FIG. 13 is a side sectional view similar to FIG. 12, illustrating the bleacher system as it starts to transition from the deployed position to a transport position.
Figure 14:
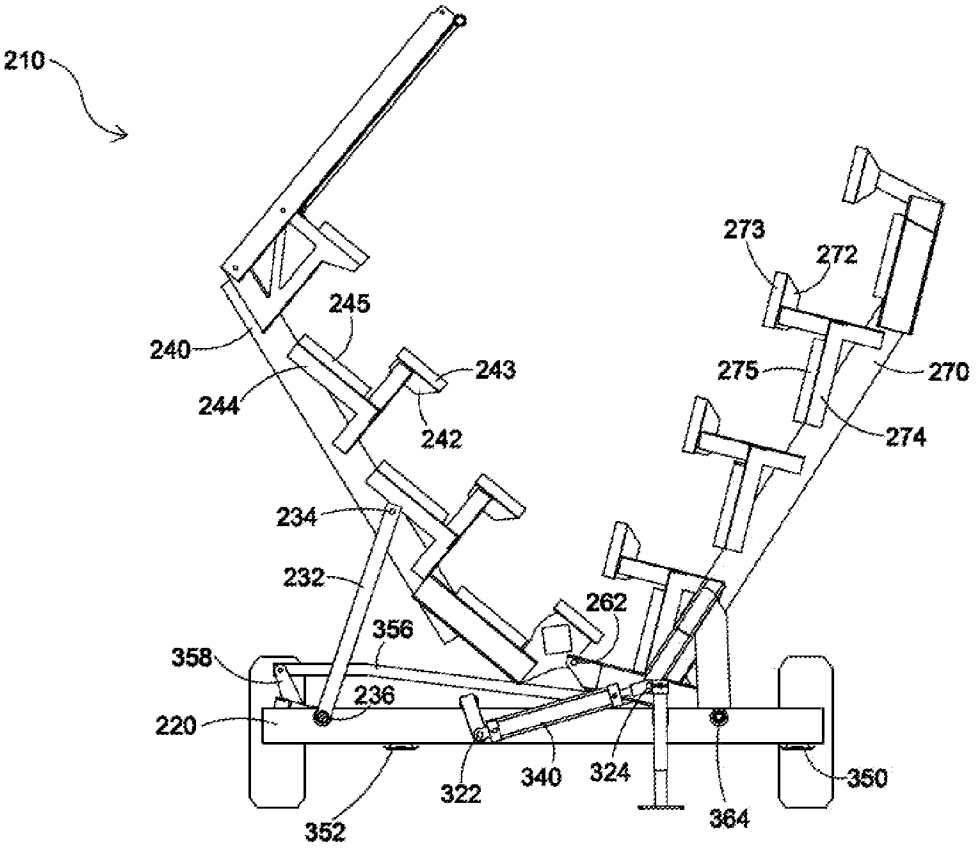
FIG. 14 is a side sectional view similar to FIG. 12, illustrating the bleacher system as it continues to transition from the deployed position to the transport position.

During the transition of the bleacher system 210 from the transport position to the deployed position, the front jack 350 and the rear jack 352 rotate (clockwise in FIGS. 12-15) to a substantially vertical orientation for engaging the underlying ground surface and providing support to the bleacher system 210; see FIG. 12.

FIGS. 16-19 are side sectional views of another exemplary bleacher system 410 made in accordance with the present invention. This bleacher system 410 has a construction very similar to that described above with respect to FIGS. 1-7, including an upper tier 430 constructed from multiple girders 440 at spaced intervals. Each girder 440 then supports multiple seat supports 442 and foot board supports 444, with respective seat planks (or seats) 443 and foot planks 445 then being secured to the respective seat supports 442 and foot board supports 444 and extending along the length of the bleacher system 410 over such seat supports 442 and foot board supports 444. Similarly, the lower tier 460 is constructed from multiple girders 470 at spaced intervals. Each girder 470 supports multiple seat supports 472 and foot board supports 474, with respective seat planks (or seats) 473 and foot planks 475 then being secured to the respective seat supports 472 and foot board supports 474 and extending along the length of the bleacher system 410 over such seat supports 472 and foot board supports 474.

A rear strut 432 is associated with each girder 440 of the upper tier 430. The rear strut 432 terminates in a slide plate (or bearing) 433 that engages and supports the girder 440, but, in this exemplary embodiment, is not attached to the girder 440. Again, there are actually multiple rear struts 432, one associated with each girder 440 along the length of the bleacher system 410. When the bleacher system 410 is in the deployed position, each rear strut 432 thus extends from girder 440 of the upper tier to a respective cross member 425 of the underlying support structure 420, where it is connected to the support structure 420.

The upper tier 430 is again connected to the lower tier 460 by a pin connection defining a pivot point 462 (i.e., "tiers pivot"). Again, there are actually multiple such pin connections and associated pivot points 462 that are aligned along the length of the bleacher system 410 that effectively define an axis of rotation along the length of the bleacher system 410. Each girder 470 of the lower tier 460 is then connected by a pin connection defining a pivot point 464 ("main pivot") to a respective cross member 425 of the support structure 420.

In this exemplary embodiment, however, there are ten rows of seats. To provide the proper mechanical advantage to transition the bleacher system 410 from the transport position to the deployed position, and vice versa, a front strut 426, which, in this case, has a triangular shape, extends upwardly from a cross member 425 of the support structure 420. One end of the hydraulic actuator 540 is connected to a vertex of the front strut 426 by a pin connection defining a pivot point 522. The rod 542 of the hydraulic actuator 540 is then connected to the lower tier 460 by another pin connection defining a pivot point 524. Thus, the pivot point 522 is at a higher elevation as compared to the analogous pivot point 122 for the exemplary embodiment (eight rows of seats) described above with respect to FIGS. 1-7. Nonetheless, operation is substantially the exemplary embodiment described above with respect to FIGS. 1-7.

When transitioning from the deployed position to the transport position, the hydraulic actuator 540 is activated, and the rod 542 of the hydraulic actuator 540 begins to retract. As the rod 542 begins to retract, the lower tier 460 begins rotating backward (counterclockwise in FIGS. 16-19) about the axis of rotation defined by the aligned pivots points 464 (or "main pivot"). As a result, the respective pivot points 562 at the pin connections between the upper tier 430 and the lower tier 460 are moved downward, and thus, the upper tier 430 begins rotating toward the lower tier 460 (clockwise in FIGS. 16-19). In other words, the extension of the rod 542 of the hydraulic actuator 540 causes the lower tier 460 to pivot about the main pivot 464 relative to the support structure 420 in a first direction, while causing the upper tier 430 to pivot relative to the support structure 420 in an opposite direction.

Referring still to FIGS. 16-19, during the transition of the bleacher system 410 from the deployed position to the transport position, similar to the embodiments described above with respect to FIGS. 1-7 and FIGS. 12-15, a front jack (or support leg) 550 and a rear jack (or support leg) 552 associated with each cross member 425 are also moved into a transport position. Specifically, the front jack 550 is pivotally connected to the cross member 425 at the main pivot 464, and the front jack 550 is also connected to the girder 470 of the lower tier 460. The rear jack 552 is pivotally connected to the cross member 425 near the rear strut 432. A jack link 556 then extends between and connects the front jack 550 to a jack link driver 558, which, in turn, is connected to the rear jack 552. Thus, in operation, when the lower tier 460 begins rotating about the main pivot 464, the front jack 550 also begins to rotate, and as result of the use of the jack link 556 and the jack link driver 558, the rear jack 552 rotates with the front jack 550. In other words, the front jack 550 and the rear jack 552 rotate together.

Figure 19:
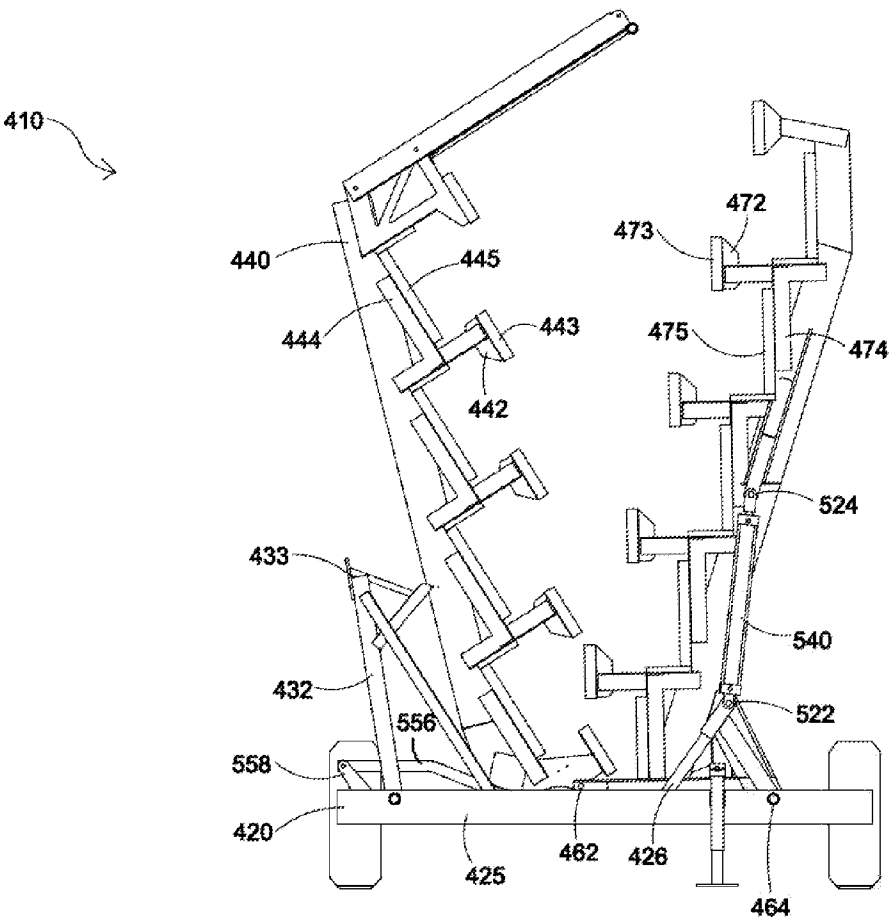
FIG. 19 is a side sectional view similar to FIG. 16, illustrating the bleacher system in the transport position.
Figure 20:
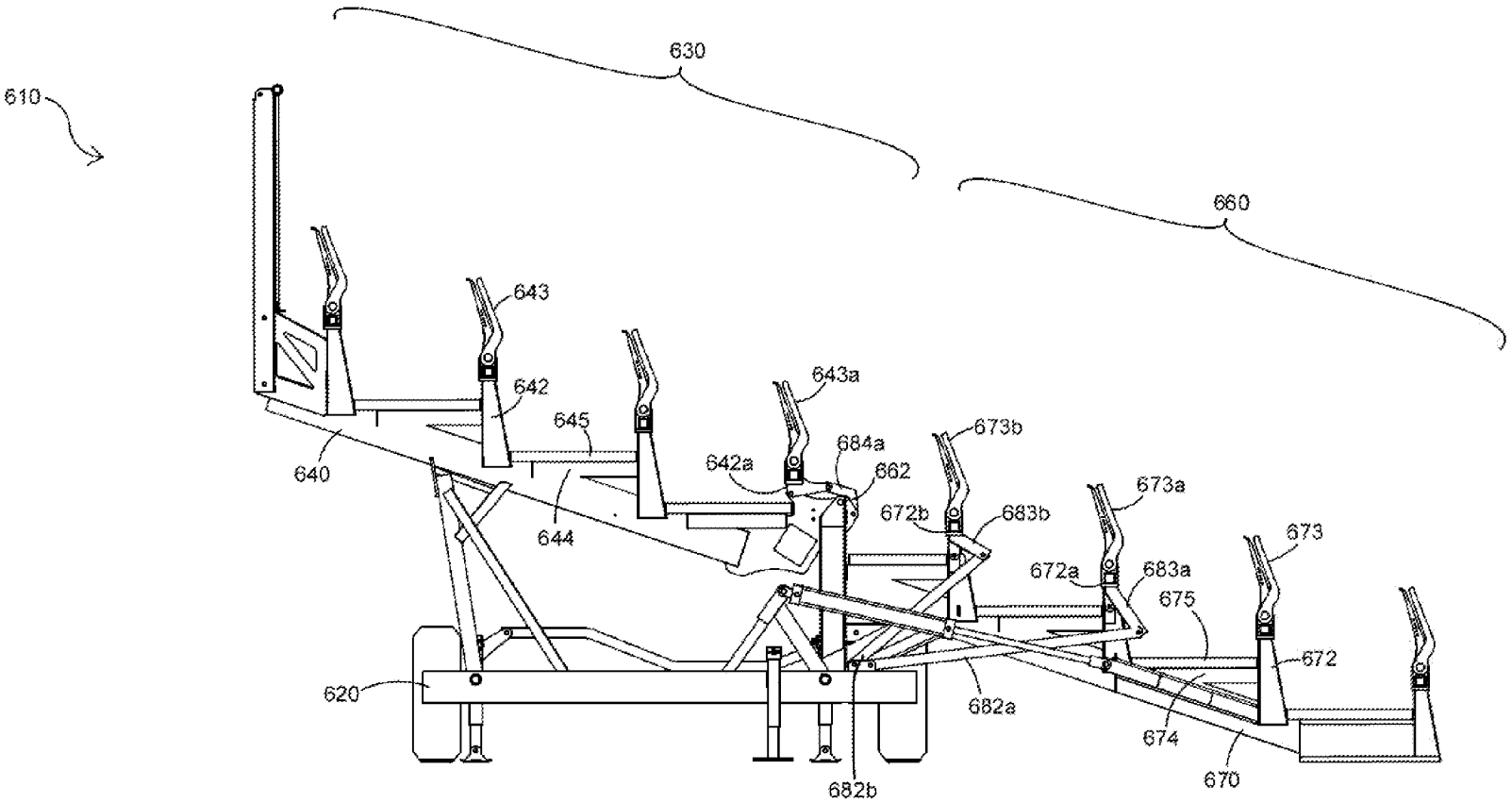
FIG. 20 is a side sectional view of another exemplary bleacher system in a deployed position, but with certain components, including the end guardrails, removed for clarity.
Figure 21:
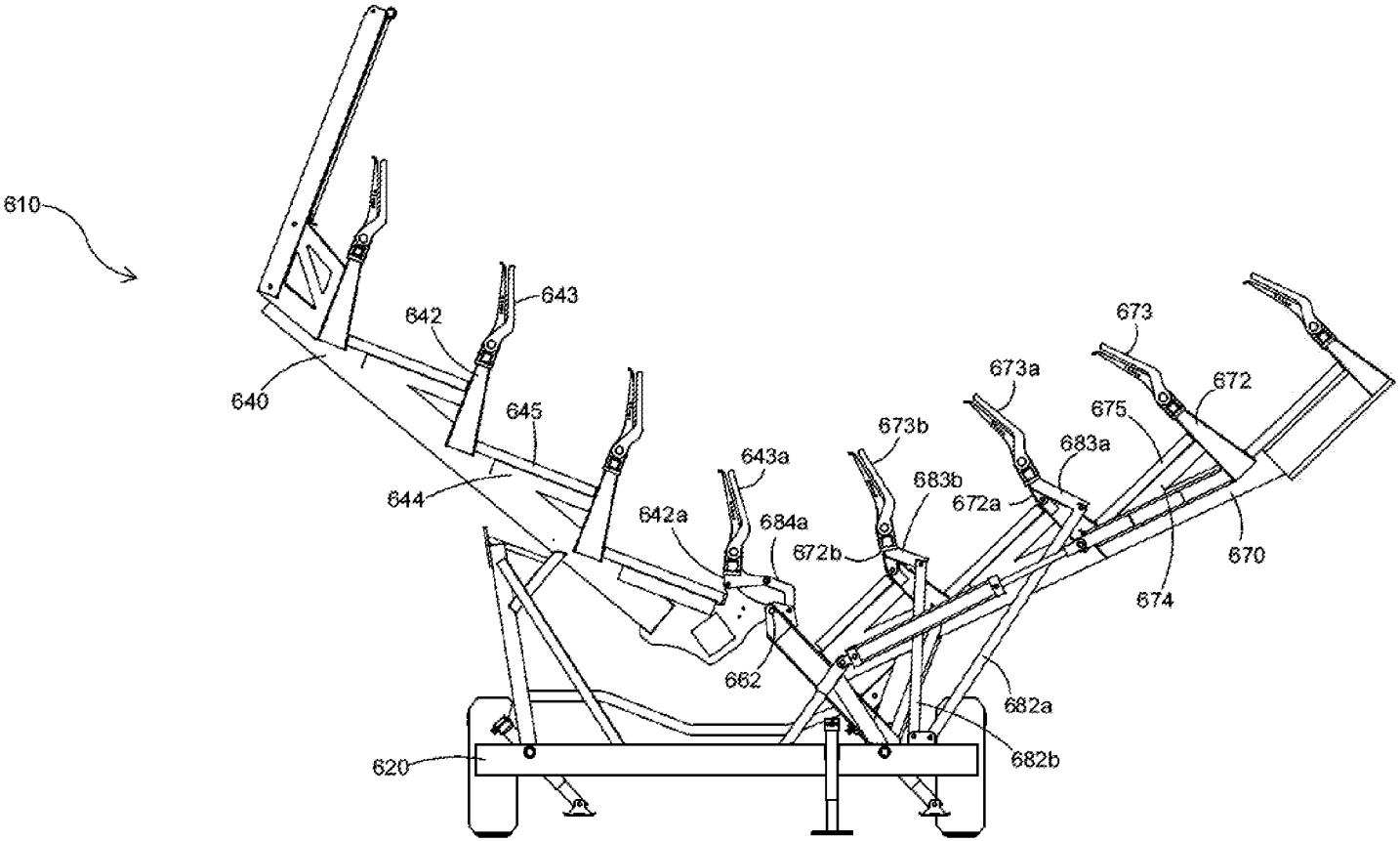
FIG. 21 is a side sectional view similar to FIG. 20, illustrating the bleacher system as it starts to transition from the deployed position to a transport position.
Figure 22:
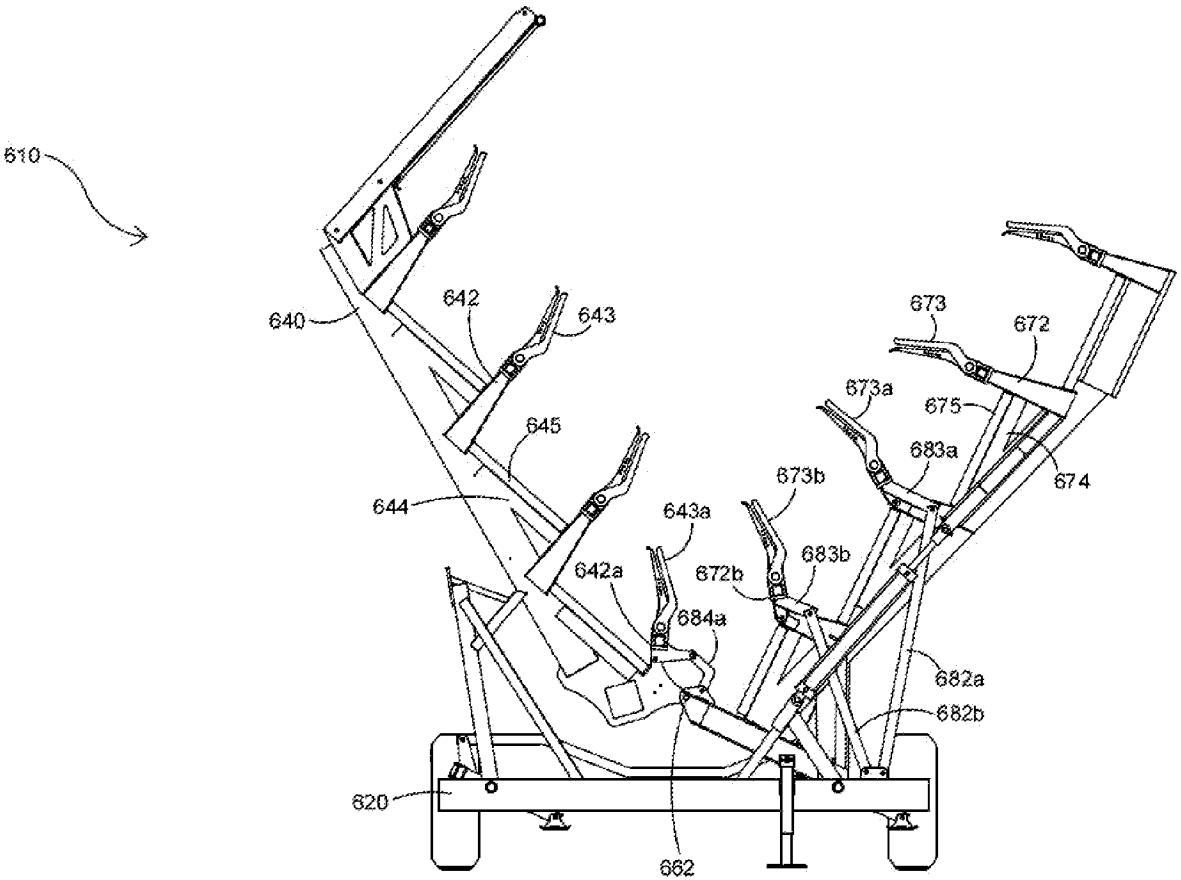
FIG. 22 is a side sectional view similar to FIG. 20, illustrating the bleacher system as it continues to transition from the deployed position to the transport position.
Figure 23:
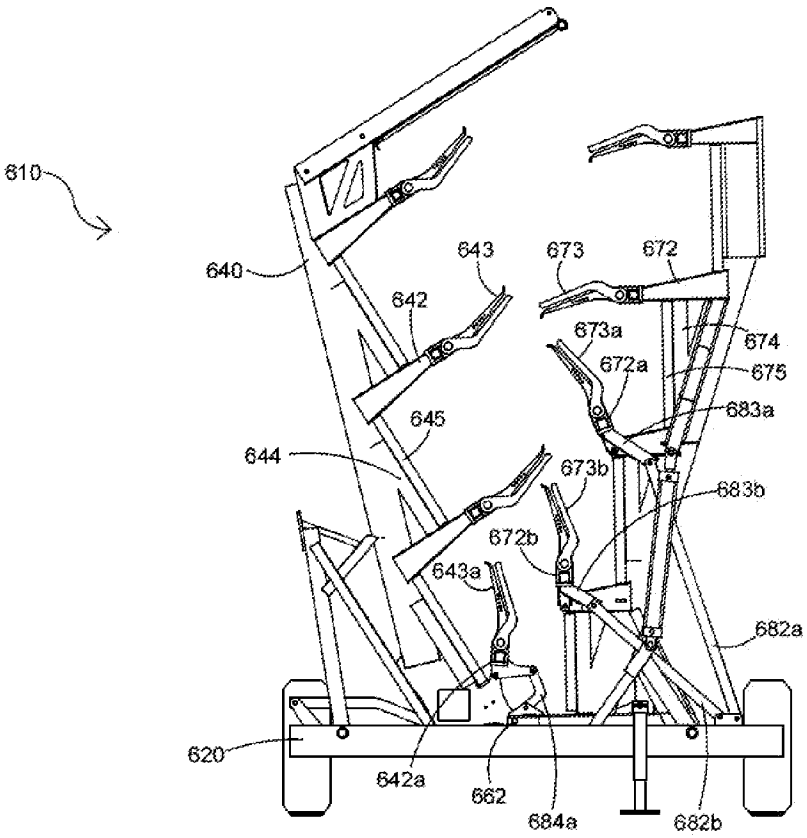
FIG. 23 is a side sectional view similar to FIG. 20, illustrating the bleacher system in the transport position.

During the transition of the bleacher system 410 from the deployed position to the transport position, the front jack 550 and the rear jack 552 rotate (counterclockwise in FIGS. 16-19) to a substantially horizontal orientation for transport; see FIG. 19, where the front jack 550 and the rear jack 552 are hidden from view behind the cross member 425.

Figure 16:
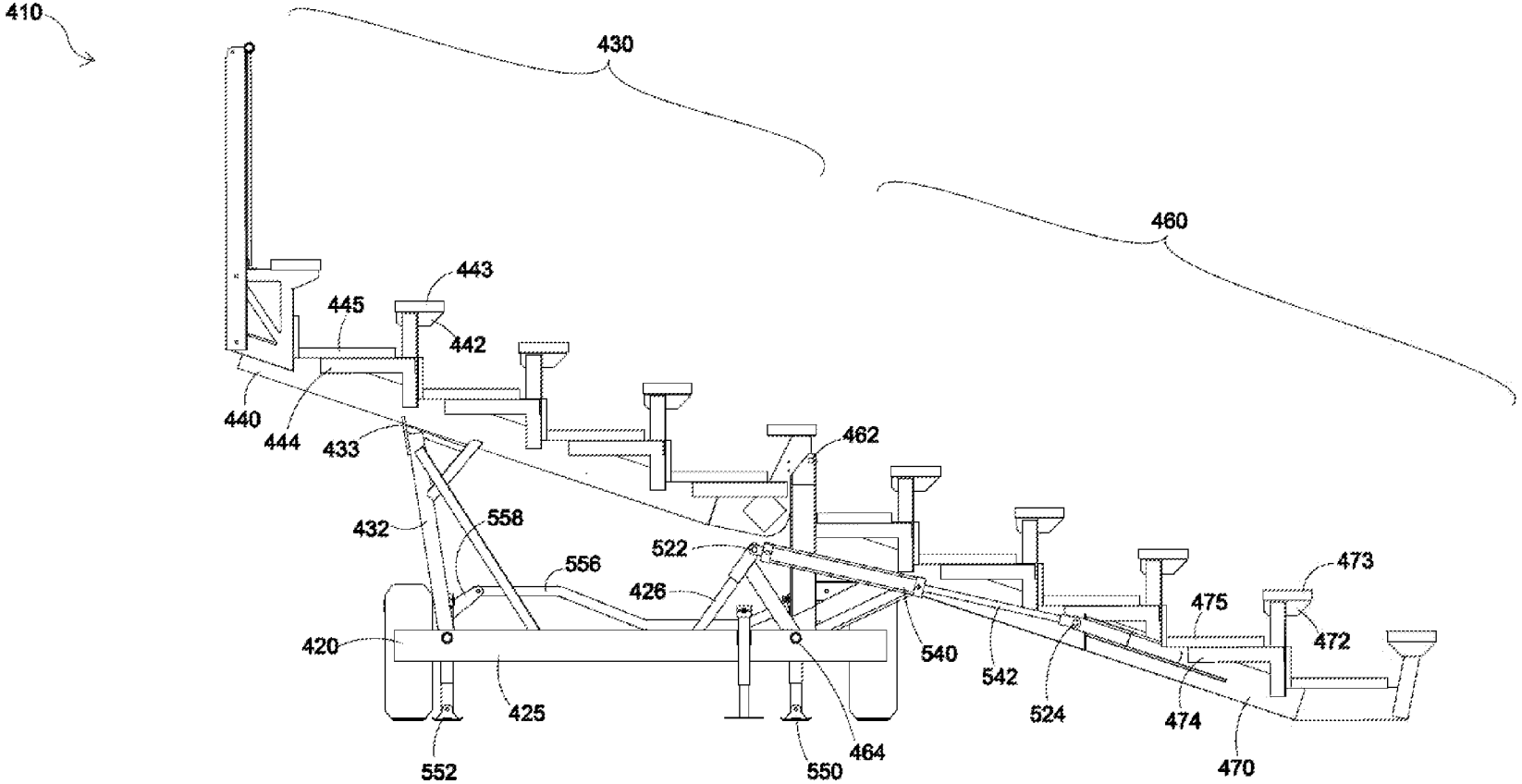
FIG. 16 is a side sectional view of another exemplary bleacher system in a deployed position, but with certain components, including the end guardrails, removed for clarity.
Figure 17:
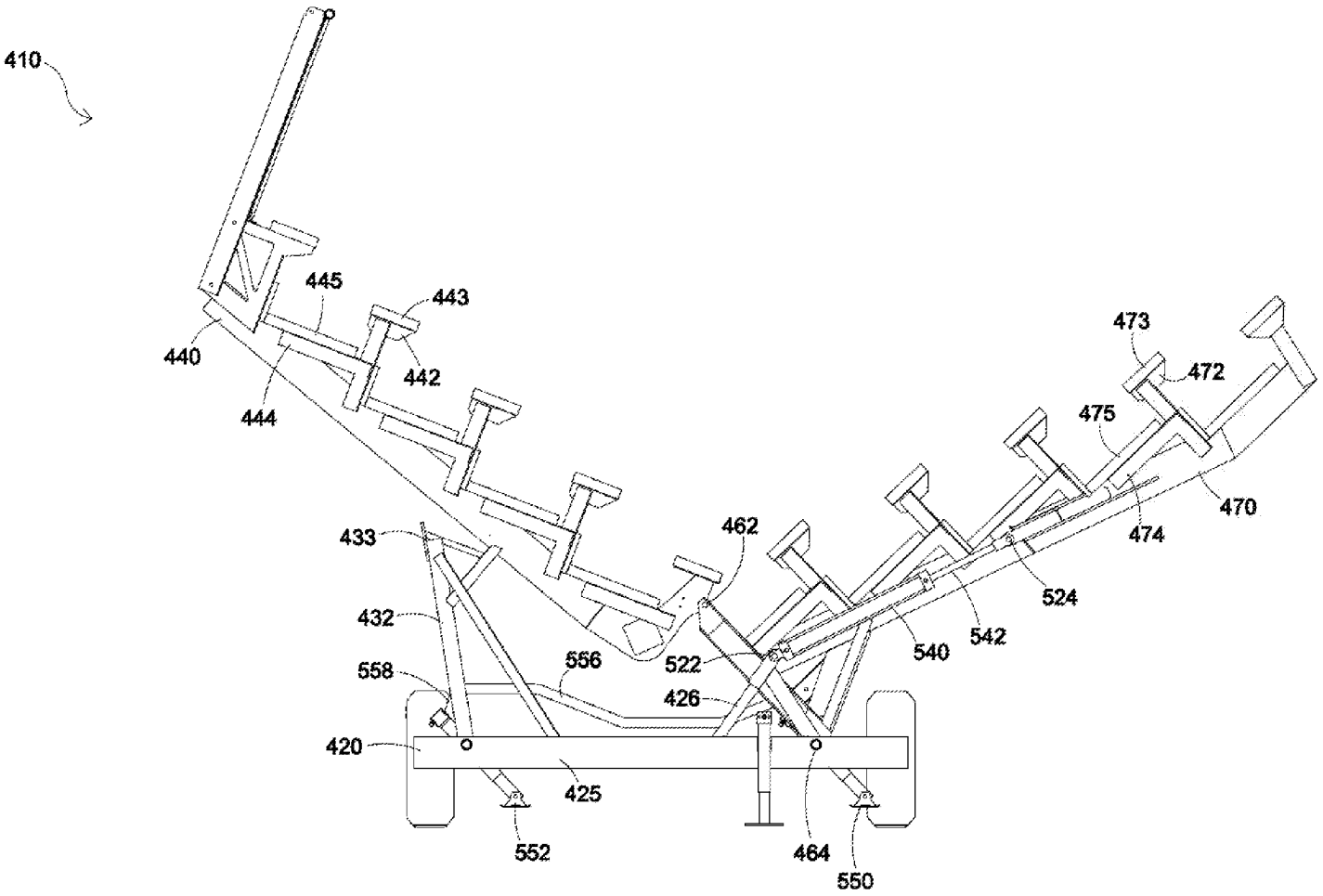
FIG. 17 is a side sectional view similar to FIG. 16, illustrating the bleacher system as it starts to transition from the deployed position to a transport position.
Figure 18:
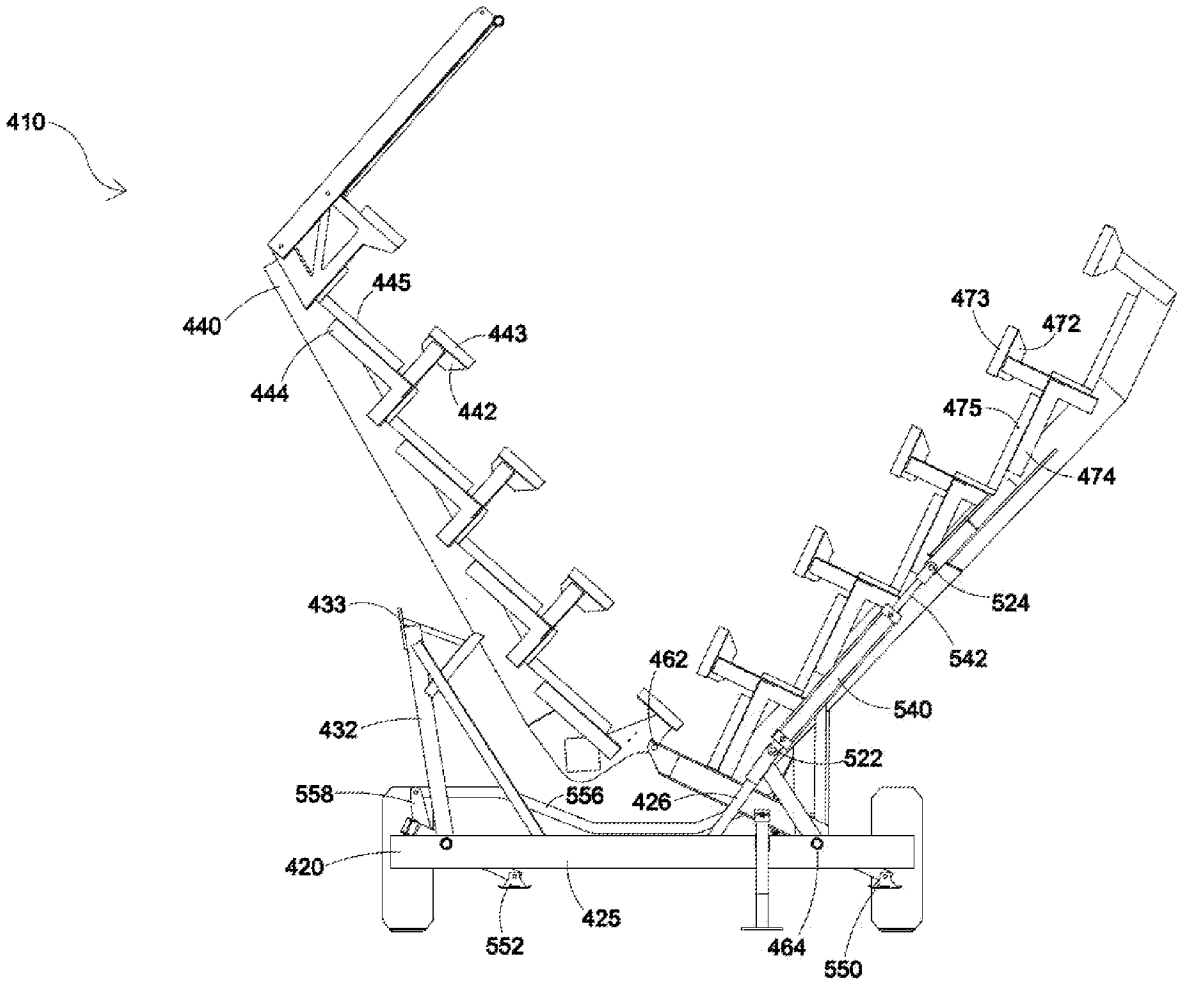
FIG. 18 is a side sectional view similar to FIG. 16, illustrating the bleacher system as it continues to transition from the deployed position to the transport position.

During the transition of the bleacher system 410 from the transport position to the deployed position, the front jack 550 and the rear jack 552 rotate (clockwise in FIGS. 16-19) to a substantially vertical orientation for engaging the underlying ground surface and providing support to the bleacher system 410; see FIG. 16.

FIGS. 20-23 are side sectional views of another exemplary bleacher system 610 made in accordance with the present invention. This bleacher system 610 is similar in construction and operation to the bleacher system 410 described above with respect to FIGS. 16-19, with one key exception. This particular bleacher system 610 again includes an upper tier 630 constructed from multiple girders 640 at spaced intervals. Each girder 640 then supports multiple seat supports 642 and foot board supports 644. Foot planks 645 are then secured to the respective foot board supports 644 along the length of the bleacher system 410. However, instead of seat planks, individual folding seats 643 are secured to and supported by the seat supports 642. Similarly, the bleacher system 610 again includes an upper tier 660 constructed from multiple girders 670 at spaced intervals. Each girder 670 then supports multiple seat supports 672 and foot board supports 674. Foot planks 675 are then secured to the respective foot board supports 674 along the length of the bleacher system 610. However, instead of seat planks, individual folding seats 673 are secured to and supported by the seat supports 672. In FIGS. 20-23, the folding seats 643, 673 are shown in a storage position. In this regard, the seats 643, 673 may be spring-loaded and biased into such a storage position. Once the bleacher system 610 is in the deployed position, the bottom portion of each seat 643, 673 can be pivoted away from the back portion to transition each seat 643, 673 into a deployed position.

The bleacher system 610 functions and transitions from the deployed position to the transport position, and vice versa, in the same manner as the embodiments described above with respect to FIGS. 1-7, FIGS. 13-16, and FIGS. 16-19. However, there is one additional refinement shown in FIGS. 20-23. In this exemplary embodiment, in order to ensure that the seats 643 of the upper tier 630 do not contact the seats 673 of the lower tier 660 or otherwise impede the transition of the bleacher system 610 to the transport position, the lowest row of seats 643*a* in the upper tier 630 and the upper two rows of seats 673*a*, 673*b* in the lower tier 660 are moved during the transition of the bleacher system 610 to the transport position. Such movement is achieved using multiple links.

With respect to the lowest row of seats 643*a* in the upper tier 630, the seat supports 642*a* are pivotally connected to a respective girder 640. A link 684*a* then extends between and is pivotally connected to the seat support 642*a* and the respective girder 670 of the lower tier 660, near the pin connection 662 between the upper tier 630 and the lower tier 660. Thus, as shown in FIGS. 20-23, as the upper tier 630 and the lower tier 660 move toward one another during the transition from the deployed position to the transport position, the seat supports 642*a* rotate relative to the girder 640 (counterclockwise in FIGS. 20-23).

With respect to the row of seats 673*a* in the lower tier 660, the seat supports 672*a* are pivotally connected to a respective girder 670. A first link 682*a* is pivotally connected to the support structure 620 at a first end and is then connected to a second link 683*a* at its opposite end. The second link 683*a* is then connected to the seat supports 672*a*. Thus, as shown in FIGS. 20-23, as the upper tier 630 and the lower tier 660 move toward one another during the transition from the deployed position to the transport position, the seat supports 672*a* rotate relative to the girder 670 (clockwise in FIGS. 20-23).

Similarly, with respect to the row of seats 673*b* in the lower tier 660, the seat supports 672*b* are pivotally connected to a respective girder 670. A first link 682*b* is pivotally connected to the support structure 620 at a first end and is then connected to a second link 683*b* at its opposite end. The second link 683*b* is then connected to the seat supports 672*b*. Thus, as shown in FIGS. 20-23, as the upper tier 630 and the lower tier 660 move toward one another during the transition from the deployed position to the transport position, the seat supports 672*b* rotate relative to the girder 670 (clockwise in FIGS. 20-23).

Finally, in the above-described exemplary embodiments, the tiers rotate relative to the support structure in the transition of the bleacher system from the deployed position to the transport position, and vice versa, and such rotation of the tiers is mechanically actuated. However, the refinements described above are not necessarily limited to such bleacher systems. For instance, it is contemplated that bleacher systems with one or more fixed tiers, along with bleacher systems with one or more tiers that are manually moved between a deployed position and a transport position could also be similarly constructed with some combinations of the above-described support structure, front jacks, rear jacks, and/or retractable hitch tube of the present invention.

One of ordinary skill in the art will recognize that additional embodiments and configurations are also possible without departing from the teachings of the present invention or the scope of the claims which follow. This description, and particularly the specific details of the exemplary embodiments disclosed, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A bleacher system, comprising:

a support structure mounted on wheels, said support structure including (a) multiple cross members at spaced intervals from one another, and (b) at least one axle carrier sub-frame mounted between two of the multiple cross members for accommodating an axle to drive the wheels;

an upper tier mounted on the support structure and including multiple girders at spaced intervals that are operably connected to the cross members of the support structure, each girder supporting a plurality of seat supports and a plurality of foot board supports, with seat planks or seats then secured to the seat supports and foot planks secured to the foot board supports in the upper tier;

a lower tier mounted on the support structure and including multiple girders at spaced intervals that are operably connected to the cross members of the support structure, each girder supporting a plurality of seat supports and a plurality of foot board supports, with seat planks or seats then secured to the seat su orts and foot planks secured to the foot board supports in the lower tier; and a hitch tube connected to and extending from the at least one of the multiple girders and including a hitch at its distal end for attachment to a vehicle when the bleacher system is in a transport position;

wherein, in the transport position, the upper and lower tiers of multiple girders, plurality of seat supports and seats secured thereto, and plurality of foot board supports and footboards secured thereto effectively form a trailer frame.

2. The bleacher system as recited in claim 1, wherein the upper tier is connected to the lower tier by a pin connection defining a pivot point.

3. The bleacher system as recited in claim 2, wherein each of the upper tier and the lower tier rotate relative to the support structure between a transport position and a deployed position.

4. The bleacher system as recited in claim 3, and further comprising at least one actuator operably connected to and extending between the support structure and the lower tier, the actuator causing the lower tier to pivot about a pivot point relative to the support structure in a first direction, while causing the upper tier to pivot relative to the lower tier in an opposite direction, such that the upper tier and the lower tier move away from one another during the transition from the transport position to the deployed position.

5. The bleacher system as recited in claim 4, and further comprising:

at least one front jack that, during transition from the transport position to the deployed position, while the upper tier and the lower tier are moving away from one another, rotates from a substantially horizontal orientation for transport to a substantially vertical orientation for engaging an underlying ground surface and providing support to the bleacher system; and at least one rear jack that, during transition from the transport position to the deployed position, while the upper tier and the lower tier are moving away from one another, rotates from a substantially horizontal orientation for transport to a substantially vertical orientation for engaging an underlying ground surface and providing support to the bleacher system.

6. The bleacher system as recited in claim 1, wherein said hitch tube is moveable between an extended position in which it extends from a front of the bleacher system and a refracted position in which it is stowed within the bleacher system.

7. A bleacher system, comprising:

a support structure;

an upper tier and a lower tier mounted on the support structure, with the upper tier being connected to the lower tier by a pin connection defining a pivot point, and each of the upper tier and the lower tier including multiple girders at spaced intervals that are operably connected to the support structure, each girder supporting a plurality of seat supports and a plurality of foot board supports, with seat planks or seats then secured to the seat supports and foot planks secured to the foot board supports in each tier;

at least one actuator operably connected to and extending between the support structure and the lower tier, the actuator causing the lower tier to pivot about a pivot point relative to the support structure in a first direction, while causing the upper tier to pivot relative to the lower tier in an opposite direction, such that the upper tier and the lower tier move away from one another during the transition from a transport position to a deployed position;

at least one front jack, wherein during transition from the transport position to the deployed position, when the upper tier and the lower tier are moving away from one another, such movement causes the at least one front jack to rotate from a substantially horizontal orientation for transport to a substantially vertical orientation for engaging an underlying ground surface and providing support to the bleacher system; and at least one rear jack, wherein during transition from the transport position to the deployed position, when the upper tier and the lower tier are moving away from one another, such movement causes the at least one front jack to rotate from a substantially horizontal orientation for transport to a substantially vertical orientation for engaging an underlying ground surface and providing support to the bleacher system.

8. The bleacher system as recited in claim 7, in which the actuator is a hydraulic actuator.

9. The bleacher system as recited in claim 7, in which the upper tier and the lower tier each include at least four rows of seat supports.

10. The bleacher system as recited in claim 7, and further comprising multiple rear struts, each rear strut being associated with one of the multiple girders of the upper tier, and each rear strut extending between the support structure and the girder.

11. The bleacher system as recited in claim 10, wherein each rear strut terminates in a slide plate that engages and supports the girder.

12. The bleacher system as recited in claim 10, and further comprising a rear support bar that extends the length of the bleacher system and connects the rear struts to one another.

13. The bleacher system as recited in claim 10, wherein each rear strut is connected to the girder by a pin connection defining a pivot point, with an opposite end of each rear strut being connected to the support structure by another pin connection defining another pivot point.

14. The bleacher system as recited in claim 7, wherein the support structure comprises:

multiple cross members; and an axle carrier sub-frame including two beams that extend between and are connected to two of the multiple cross members and are oriented substantially perpendicular to the cross members.

15. The bleacher system as recited in claim 14, wherein each end of each beam terminates in a bracket, and wherein the bracket defines a hole for receiving a tube, said tube then also passing through a corresponding hole defined by one of the multiple cross members.

16. The bleacher system as recited in claim 15, wherein the tube also passes through a portion of one of the multiple girders of the lower tier, thus defining the pivot point between the lower tier and the support structure.

17. The bleacher system as recited in claim 15, wherein the tube also passes through the front jack, thus creating a pivot connection between the front jack and the cross member.

18. The bleacher system as recited in claim 16, wherein the tube also passes through the front jack, thus creating a pivot connection between the front jack and the cross member.

19. A bleacher system, comprising:

a support structure, including multiple cross members;

an upper tier and a lower tier mounted on the support structure, with the upper tier being connected to the lower tier by a pin connection defining a pivot point, and each of the upper tier and the lower tier including multiple girders at spaced intervals that are operably connected to the cross members of the support structure, each girder supporting a plurality of seat supports and a plurality of foot board supports, with seat planks or seats then secured to the seat supports and foot planks secured to the foot board supports in each tier;

at least one actuator operably connected to and extending between the support structure and the lower tier, the actuator causing the lower tier to pivot about a main pivot relative to the support structure in a first direction, while causing the upper tier to pivot relative to the lower tier in an opposite direction, such that the upper tier and the lower tier move away from one another during the transition from a transport position to a deployed position; and at least one front jack, wherein during transition from the transport position to the deployed position, when the upper tier and the lower tier are moving away from one another, such movement causes the at least one front jack to rotate from a substantially horizontal orientation for transport to a substantially vertical orientation for engaging an underlying ground surface and providing support to the bleacher system;

wherein the support structure further includes an axle carrier sub-frame mounted between two of the multiple cross members of the support structure and operably connected to the support structure at the main pivot.

20. The bleacher system as recited in claim 19, and further comprising:

at least one rear jack, wherein during transition from the transport position to the deployed position, when the upper tier and the lower tier are moving away from one another, such movement causes the at least one front jack to rotate from a substantially horizontal orientation for transport to a substantially vertical orientation for engaging an underlying ground surface and providing support to the bleacher system.

21. A bleacher system, comprising:

a support structure including multiple cross members at spaced intervals from one another;

one or more tiers mounted on the support structure, each of the one or more tiers including multiple girders at spaced intervals that are operably connected to the cross members of the support structure, each girder supporting a plurality of seat supports and a plurality of foot board supports, with seat planks or seats then secured to the seat supports and foot planks secured to the foot board supports in each tier; and a hitch tube with a hitch at its distal end, said hitch tube being connected to and extending from at least one of the multiple girders, and said hitch tube being moveable between an extended position in which it extends from a front of the bleacher system and a retracted position in which it is stowed within the bleacher system.

22. A bleacher system, comprising:

a support structure, including multiple cross members and an axle carrier sub-frame mounted between two of the multiple cross members of the support structure;

an upper tier and a lower tier mounted on the support structure, with the upper tier being connected to the lower tier by a pin connection defining a pivot point, and each of the upper tier and the lower tier including multiple girders at spaced intervals that are operably connected to the cross members of the support structure, each girder supporting a plurality of seat supports and a plurality of foot board supports, with seat planks or seats then secured to the seat supports and foot planks secured to the foot board supports in each tier;

at least one actuator operably connected to and extending between the support structure and the lower tier, the actuator causing the lower tier to pivot about a main pivot relative to the support structure in a first direction, while causing the upper tier to pivot relative to the lower tier in an opposite direction, such that the upper tier and the lower tier move away from one another during the transition from a transport position to a deployed position;

multiple front jacks, wherein during transition from the transport position to the deployed position, when the upper tier and the lower tier are moving away from one another, such movement causes each of the multiple front jacks to rotate about a front pivot connection from a substantially horizontal orientation for transport to a substantially vertical orientation for engaging an underlying ground surface and providing support to the bleacher system; and multiple rear jacks, wherein during transition from the transport position to the deployed position, when the upper tier and the lower tier are moving away from one another, such movement causes each of the multiple rear jacks to rotate about a rear pivot connection from a substantially horizontal orientation for transport to a substantially vertical orientation for engaging an underlying ground surface and providing support to the bleacher system;

wherein the axle carrier sub-frame is mounted between two of the multiple cross members of the support structure at the front and rear pivot connections associated with the front jacks and the rear jacks.

23. A bleacher system, comprising:

a support structure mounted on wheels, said support structure consisting of (a) multiple cross members at spaced intervals from one another, and (b) at least one axle carrier sub-frame mounted between two of the multiple cross members for accommodating an axle to drive the wheels;

an upper tier mounted on the support structure and including multiple girders at spaced intervals that are operably connected to the cross members of the support structure, each girder supporting a plurality of seat supports and a plurality of foot board supports, with seat planks or seats then secured to the seat supports and foot planks secured to the foot board supports in the upper tier;

a lower tier mounted on the support structure and including multiple girders at spaced intervals that are operably connected to the cross members of the support structure, each girder supporting a plurality of seat supports and a plurality of foot board supports, with seat planks or seats then secured to the seat supports and foot planks secured to the foot board supports in the lower tier; and a hitch tube connected to and extending from the at least one of the multiple girders and including a hitch at its distal end for attachment to a vehicle when the bleacher system is in a transport position;

wherein, in the transport position, the upper and lower tiers of multiple girders, plurality of seat supports and seats secured thereto, and plurality of foot board supports and footboards secured thereto effectively form a trailer frame, with a direct load path from the upper and lower tiers, through the one or more axle carrier sub-frames, and through the wheels to an underlying ground surface.

24. The bleacher system as recited in claim 14, wherein the at least one front jack is pivotally connected to one of the multiple cross members and is also connected to one of the multiple girders of the lower tier, such that, during transition from the transport position to the deployed position, while the upper tier and the lower tier are moving away from one another, the at least one front jack rotates from a substantially horizontal orientation for transport to a substantially vertical orientation for engaging an underlying ground surface and providing support to the bleacher system.

* * * * *

UNITED STATES PATENT AND TRADEMARK OFFICE

CERTIFICATE OF CORRECTION

PATENT NO. : 9,021,746 B1
APPLICATION NO. : 14/138707
DATED : May 5, 2015
INVENTOR(S) : Robert Uhl It is certified that error appears in the above-identified patent and that said Letters Patent is hereby corrected as shown below:

In the Claims,

Claim 1, col. 16, line 28, delete “su orts” and replace with “supports”

Claim 6, col. 17, line 6, delete “refracted” and replace with “retracted”

Signed and Sealed this
Twenty-third Day of February, 2016

Michelle K. Lee

Michelle K. Lee
*Director of the United States Patent and Trademark Office*